US005840049A

United States Patent [19]

Tumey et al.

[11] Patent Number: 5,840,049

[45] Date of Patent: Nov. 24, 1998

[54] MEDICAL PUMPING APPARATUS

[75] Inventors: David Malcolm Tumey, Huber Heights; Robert Louis Cartmell, Bellbrook, both of Ohio

[73] Assignee: Kinetic Concepts, Inc., San Antonio, Tex.

[21] Appl. No.: 524,606

[22] Filed: Sep. 7, 1995

[51] Int. Cl.[6] ..... A61H 23/04

[52] U.S. Cl. ..... 601/149; 601/150; 601/152; 137/856

[58] Field of Search ..... 601/9, 11, 48, 601/55, 61, 149–152; 137/855–7, 899.4; 417/38

[56] References Cited

U.S. PATENT DOCUMENTS

| | | |
|---|---|---|
| 1,492,514 | 4/1924 | Jensen . |
| 1,608,239 | 11/1926 | Rosett . |
| 2,531,074 | 11/1950 | Miller . |
| 2,638,090 | 5/1953 | Nantz . |
| 2,694,395 | 11/1954 | Brown . |
| 2,781,041 | 2/1957 | Weinberg . |
| 2,880,721 | 4/1959 | Corcoran . |
| 2,893,382 | 7/1959 | Demeny . |
| 3,171,410 | 3/1965 | Towle, Jr. et al. . |
| 3,403,673 | 10/1968 | MacLeod . |
| 3,525,333 | 8/1970 | Menacci . |
| 3,774,598 | 11/1973 | Wilson et al. . |

(List continued on next page.)

FOREIGN PATENT DOCUMENTS

| | | |
|---|---|---|
| 0514204 | 11/1992 | European Pat. Off. . |
| 2390156 | 1/1979 | France . |
| 0039629 | 11/1981 | France . |
| 2430651 | 1/1976 | Germany . |
| 2716137 | 7/1978 | Germany . |
| 3009408 | 9/1981 | Germany . |
| 8530877 | 10/1985 | Germany . |

(List continued on next page.)

OTHER PUBLICATIONS

MacEachern et al., "The Venous Foot Pump," Paper presented at the British Orthopedic Assoc., Autumn Meeting, Sep. 18–20, 1985.

Gardner et al., "Reduction of Post–Traumatic Swelling and Compartment Pressure by Impulse Compression of the Foot," *The Journal of Bone & Joint Surgery*, vol. 72B, No. 5, Sep. 1990, pp. 810–815.

Gardner et al., "The Venous Pump of the Human Foot–Preliminary Report," Bristol Medico–Chisurgical Journal, Jul. 1983.

(List continued on next page.)

*Primary Examiner*—Danton D. DeMille

*Attorney, Agent, or Firm*—Killworth, Gottman, Hagan & Schaeff, L.L.P.

[57] ABSTRACT

An improved medical pumping apparatus for increasing or stimulating blood flow in a patient's limb extremity. The medical apparatus includes a fluid supply mechanism for applying pressurized fluid to an inflatable bag, according to the principles of the present invention, where the bag is adapted to be fitted upon the limb extremity of a patient. The bag has at least one fluid bladder, and preferably separate first and second fluid bladders. Each fluid bladder is adapted to engage a different portion of the limb extremity. The fluid supply mechanism applies pressurized fluid to each bladder such that a compressive pressure is applied upon each portion of the limb extremity engaged by a fluid bladder. The fluid supply mechanism includes a compressor for providing the pressurized fluid, and a reservoir for storing pressurized fluid from the compressor. The fluid supply mechanism is operatively adapted so that the medical pumping apparatus can be operated for longer periods of time before the compressor has to be serviced or replaced. This improvement in the service life of the compressor can be accomplished by adapting the fluid supply mechanism to include a pressure control unit operatively adapted for controlling the operation of the compressor. For at least some compressors with an exhaust valve, this improvement can also be obtained by adapting the compressor in the fluid supply mechanism to include an exhaust filter disposed so as to filter the air before it is forced out through the exhaust valve.

8 Claims, 15 Drawing Sheets

U.S. PATENT DOCUMENTS 3,811,431 5/1974 Apstein .
3,824,992 7/1974 Nicholson et al. .
3,826,249 7/1974 Lee et al. .
3,835,845 9/1974 Maher .
3,859,989 1/1975 Spielberg .
3,865,102 2/1975 Birtwell et al. .
3,865,103 2/1975 Folman .
3,866,604 2/1975 Curless et al. .
3,888,242 6/1975 Harris et al. .
3,892,229 7/1975 Taylor et al. .
3,892,531 7/1975 Shaffer .
3,908,642 9/1975 Vinmont .
3,920,006 11/1975 Lapidus .
3,942,518 3/1976 Tenteris et aal. .
3,976,056 8/1976 Brawn .
4,029,087 6/1977 Dye et al. .
4,030,488 6/1977 Hasty .
4,044,759 8/1977 Ghayowan .
4,054,129 10/1977 Byars et al. .
4,077,402 3/1978 Benjamin, Jr. et al. .
4,091,804 5/1978 Hasty .
4,153,050 5/1979 Bishop et al. .
4,186,732 2/1980 Christoffel .
4,198,961 4/1980 Arkans .
4,202,325 5/1980 Villari et al. .
4,206,751 6/1980 Schneider .
4,207,876 6/1980 Annis .
4,231,355 11/1980 Hara .
4,264,282 4/1981 Crago ..... 417/38 X
4,269,175 5/1981 Dillon .
4,270,527 6/1981 Peters et al. .
4,311,135 1/1982 Brueckner et al. .
4,370,975 2/1983 Wright .
4,372,297 2/1983 Perlin .
4,374,518 2/1983 Villanueva .
4,402,312 9/1983 Villari et al. .
4,408,599 10/1983 Mummert .
4,418,690 12/1983 Mummert .
4,453,538 6/1984 Whitney .
4,461,301 7/1984 Ochs .
4,477,559 10/1984 Blazek et al. .
4,502,470 3/1985 Kiser et al. .
4,519,395 5/1985 Hrushesky .
4,552,133 11/1985 Kawaguchi .
4,574,812 3/1986 Arkans .
4,577,626 3/1986 Marukawa et al. .
4,614,179 9/1986 Gardner et al. .
4,624,244 11/1986 Taberi .
4,696,289 9/1987 Gardner et al. .
4,702,232 10/1987 Gardner et al. .
4,721,101 1/1988 Gardner et al. .
4,753,226 6/1988 Zheng et al. .
4,773,397 9/1988 Wright et al. .
4,809,684 3/1989 Gardner et al. .
4,841,956 6/1989 Gardner et al. .
4,846,160 7/1989 Gardner et al. .
4,858,147 8/1989 Conwell .
4,945,905 8/1990 Dye et al. .
4,974,597 12/1990 Walloch .
4,993,420 2/1991 Welkovitz et al. .
5,014,714 5/1991 Millay et al. .
5,025,781 6/1991 Ferrari .
5,031,604 7/1991 Dye .
5,060,279 10/1991 Crawford et al. .
5,090,417 2/1992 Mollan et al. .
5,099,851 3/1992 Hata et al. .
5,121,745 6/1992 Israel .
5,126,967 6/1992 Simko .
5,157,733 10/1992 Takeo et al. .
5,207,214 5/1993 Romano .
5,288,286 2/1994 Davies et al. .
5,443,440 8/1995 Tumey et al. .

FOREIGN PATENT DOCUMENTS 632354 11/1978 Russian Federation .
233387 5/1926 United Kingdom .
473639 10/1937 United Kingdom .
479261 2/1938 United Kingdom .
490341 8/1938 United Kingdom .
754883 8/1956 United Kingdom .
2050174 1/1981 United Kingdom .
2055580 3/1981 United Kingdom .
2077108 12/1981 United Kingdom .
2103489 2/1983 United Kingdom .
2141938 1/1985 United Kingdom .
2148720 6/1985 United Kingdom .
813352 5/1989 United Kingdom .
88/09653 12/1988 WIPO .
8906521 7/1989 WIPO .
8911845 12/1989 WIPO .
9103979 4/1991 WIPO .
93/12708 7/1993 WIPO .

OTHER PUBLICATIONS

Brochure, "The AV–1000—A Remarkable New Non–Invasive Diagnostic Tool that Belongs in Every Physician's Office," Hemodynamics, Inc.

Blazek et al., "Functional Diagnostics of Peripheral Vein Disorders," Oct. 1984, pp. 4–7.

Weinert, Photoplethyemography (PPG) and Light Reflection Rheography (LRR), pp. 31–33.

Hubner, "Is the Light Reflection Rheography (LRR) Suitable as a Diagnostic Method for the Phlebology Practice?", *Phlebology and Proctology*, 1986; 15, pp. 209–212.

Correlation of Venous Pressure Measurements with Light Reflection Rheography (LRR), Hemodynamics Inc.

Stubbs, "Neurocomputers," pp. 1–12.

McCarthy et al., "A New Method of Preventing the Fatal Embolus," *Surgery*, vol. 25, No. 6, Jun. 1949, pp. 891–896.

Gaskell et al., "The Effect of a Mechanical Venous Pump on the Circulation in the Feet in the Presence of Arterial Obstruction," *Surgery, Gynecology & Obstetrics,*vol. 146, pp. 583–592, Apr. 1978.

Brochure, Flowtron Air, Ventilated Compression System, Huntleight Technology, England and Aberdeen, New Jersey.

Brochure, "Hemaflo–Intermittent Compression," Medipec, Jackson, Michigan.

Kuster et al., "Anatomy of the Veins of the Foot," *Surgery, Gynecology & Obstetrics*, pp. 817–823, Oct. 1968.

Rastgeldi, "I. Pressure Treatment of Peripheral Vascular Diseases and II. Intermittent Pressure Treatment of Peripheral Vascular Diseases," Puscula Medica, Supplementum XXVII 1972, pp. 1–49.

"Chapitre VII. Marche Du Sang Dans Le Membre Inferieur.—Des Conditions Qui President a la Direction et a la Vitesse de L'Ecoulement," Adrien Delahaye, 1869:60–includes English translation.

Cotton et al., "The prevention of deep vein thrombosis, with particular reference to mechanical methods of prevention", *Surgery*, vol. 81, No. 2, pp. 228–235, Feb. 1977.

Dillon, "An End–Diastolic Air Compression Boot for Circulation Augmentation," *Journal of Clinical Engineering*, vol. 5, No. 1, pp. 63–66, Jan.–Mar. 1980.

Clark et al., "Pneumatic Compression of the Calf and Postoperative Deep–Vein Thrombosis", *The Lancet*, pp. 5–7, Jul. 6, 1974.

Winckler, "Les Veins Du Peid"(The Veins of the Foot), Arch. anat. (Strasbourg) 37, pp. 175–184, 1923—includes English translation.

Pegum et al., "Anatomy of Venous Return from the Foot," Cardiovasc. Res., vol. 1, pp. 241–248, 1967 *Engineering*, vol. 5, No. 1, pp. 63–66, Jan.–Mar. 1980.

Pegum et al., "Physiology of Venous Return from the Foot," *Cardiovasc. Res.*, vol. 1, pp. 249–254, 1967.

Gullmo, "The Strain of Obstruction Syndrome of the Femoral Vein," *Acta. Radiologica,* vol. 46, pp. 119–137, submitted for publication Jul. 9, 1956.

Chermet, "Atlas of Phlebography of the Lower Limbs including the Iliac Veins," The Hague, p. 37, 1982.

Roberts et al., "The Effect of Intermittently Applied External Pressure on the Hemodynamics of the Lower Limb in Man," *Brit. J. Surg*., vol. 59, No. 3, pp. 223–226, Mar. 1972.

Basmajian et al., "The Role of Muscles in Arch Support of the Foot," *The Journal of Bone and Joint Surgery*, vol. 45–A, No. 6, pp. 1814–1990, Sep. 6, 1963.

Basmajian et al., "An Electromyographic Study of Certain Muscles of the Leg and Foot in the Standing Position," *Surgery, Gynecology and Obstetrics*, pp. 662–666.

Scheinberg et al., "The Relation Between Arterial Pressure and Blood Flow in the Foot," American Heart Journal, pp. 409–420, 1948.

MEDICAL PUMPING APPARATUS

FIELD OF THE INVENTION

The present invention relates generally to medical pumping apparatus, more particularly to such an apparatus having an inflatable bag for applying compressive pressures to separate portions of a patient's limb extremity, such as a foot, and even more particularly, to such an apparatus having a compressor for inflating the bag and a control system for controlling and regulating the operation of the compressor.

BACKGROUND OF THE INVENTION

Medical pumping apparatus have been employed to increase or stimulate blood flow in a limb extremity, such as a hand or a foot. Such pumping devices typically include a bag adapted for being inflated with compressed air to effect such an increase in venous blood flow. An electrically powered air compressor is typically used to provide the necessary compressed air. The compressor provides a certain amount of air pressure which is determined by the requirements associated with the particular application. Normally, the compressor is operated continuously even after the required pressure has been obtained. The problem with this approach is that the compressor can only be operated for a finite period of time before requiring service or replacement. The life span of the compressor is also affected by heat build-up, which is exacerbated by continuous operation.

Accordingly, there is a need for an improved medical pumping apparatus having a bag inflated with compressed air from an electrically or otherwise powered air compressor, where the pumping apparatus can be operated for longer periods of time before having to service or replace the compressor.

SUMMARY OF THE INVENTION

This need is met by providing an improved medical pumping apparatus which includes a fluid supply mechanism for applying pressurized fluid to an inflatable bag, according to the principles of the present invention, where the bag is adapted to be fitted upon the foot or other limb extremity of a patient. The bag has at least one fluid bladder, and preferably separate first and second fluid bladders. Each fluid bladder is adapted to engage a different portion of the limb extremity. The fluid supply mechanism applies pressurized fluid to each bladder such that a compressive pressure is applied upon each portion of the limb extremity engaged by a fluid bladder. The fluid supply mechanism includes a compressor for providing the pressurized fluid, and a reservoir for storing pressurized fluid from the compressor. The fluid supply mechanism is operatively adapted so that the medical pumping apparatus can be operated for longer periods of time before the compressor has to be serviced or replaced.

In one aspect of the present medical pumping apparatus, this improvement in the service life of the compressor can be accomplished by adapting the fluid supply mechanism to include a pressure control unit operatively adapted for controlling the operation of the compressor. By controlling the compressor, the control unit controls the pressure of the fluid in the reservoir. The pressure control unit can control the operation of the compressor in a number of ways understood by those skilled in the art, and the present invention is not intended to be limited to any particular method or apparatus for accomplishing this control.

One way the operation of the compressor can be controlled is in response to changes in the fluid pressure in the reservoir. Such a pressure control unit can include the feature of a pressure sensor for detecting a fluid pressure that is at least indicative of the fluid pressure in the reservoir, if not directly measuring the reservoir fluid pressure. In order to detect the fluid pressure in the reservoir, the pressure sensor can be connected to a fluid line, providing fluid communication between the compressor and the reservoir, or connected directly into the reservoir. The pressure sensor can be electrical or mechanical in design.

An additional feature of such a pressure control unit is a mechanical or electrical switching mechanism for controlling the operation of the compressor by controlling the supply of power from a power source (e.g., a standard electric outlet) to the compressor. The switching mechanism can be used for turning the compressor on or off, or for cycling the compressor on and off (e.g., by using a duty cycle). For a pressure control unit which controls the compressor in response to fluid pressure in the reservoir, the switching mechanism can be adapted to turn the compressor on when the pressure in the reservoir drops to a desired low pressure level or below that low pressure level. This switching mechanism can also be adapted to turn the compressor off when the pressure in the reservoir reaches or exceeds a desired high pressure level. Either or both of the low and high pressure levels can be preset. Thus, the pressure control unit can automatically shut the compressor off when the pressure required for proper operation of the pumping device is obtained and automatically turn the compressor back on when additional air compression is needed.

In another aspect of the present medical pumping apparatus, for at least some compressors, the present medical pumping apparatus can be operated for longer periods of time before the compressor has to be serviced or replaced by adapting the compressor in the fluid supply mechanism to include an exhaust valve, with an exhaust filter disposed so as to filter the air before it is forced out through the exhaust valve. It has been discovered that a compressor, which internally generates airborne particulate matter during its operation and includes an exhaust valve sensitive to such particulate, can be run continuously for longer periods of time without having to be serviced or replaced by using such an exhaust filter.

Automatically cycling the compressor on and off can allow the compressor to rest for a majority of the time that the present medical pumping apparatus is in use. For at least some compressors, filtering internally generated dust and other particulate from the air before the particulate has a chance to accumulate in significant amounts on the exhaust valve can enable the compressor to significantly maintain its efficiency and output for longer periods of time, even while being run continuously. In this way, using either or both of the above aspects of the present invention can greatly increase the effective life span of the compressor and reduce the maintenance it may require during its service life.

The type of medical pumping device which can benefit from using the fluid supply mechanism according to the principles of the present invention includes those devices having a generator for cyclically generating fluid pulses during periodic inflation cycles and a fluid conductor connected to communicate the fluid pulses to the one or more bladders. It can also be desirable for the medical pumping device to include a safety vent port associated with the inflatable bag and/or the fluid conductor to vent pressurized fluid from one or more of the bladders.

The present invention can be used with various portions of the human foot or other limb extremities including the plantar arch, the heel, a forward portion of the sole and the dorsal aspect of the foot.

The inflatable bag can be formed from two panels of flexible material, such as polyurethane or polyvinyl chloride.

The inflatable bag can be secured in place, for example, with a boot which receives the bag and includes first and second tabs adapted to connect with one another after the boot and the bag are fitted upon a foot to hold the boot and the bag to the foot.

Accordingly, it is an object of the present invention to provide an improved medical pumping apparatus having an inflatable bag which engages a substantial portion of a patient's limb extremity to achieve optimum blood flow at an acceptable patient comfort level.

It is another object of the present invention to provide a medical pumping apparatus which can be operated for longer overall periods of time before its compressor has to be serviced or replaced.

It is an additional object of the present invention to provide such an improved medical pumping apparatus having a compressor which can be operated continuously and/or periodically and still maintain the pressure of the fluid in its reservoir at an appropriate level.

These and other objects, features and advantages of the present invention will be apparent from the following description, the accompanying drawings and the appended claims.

DETAILED DESCRIPTION OF THE INVENTION

Figure 1:
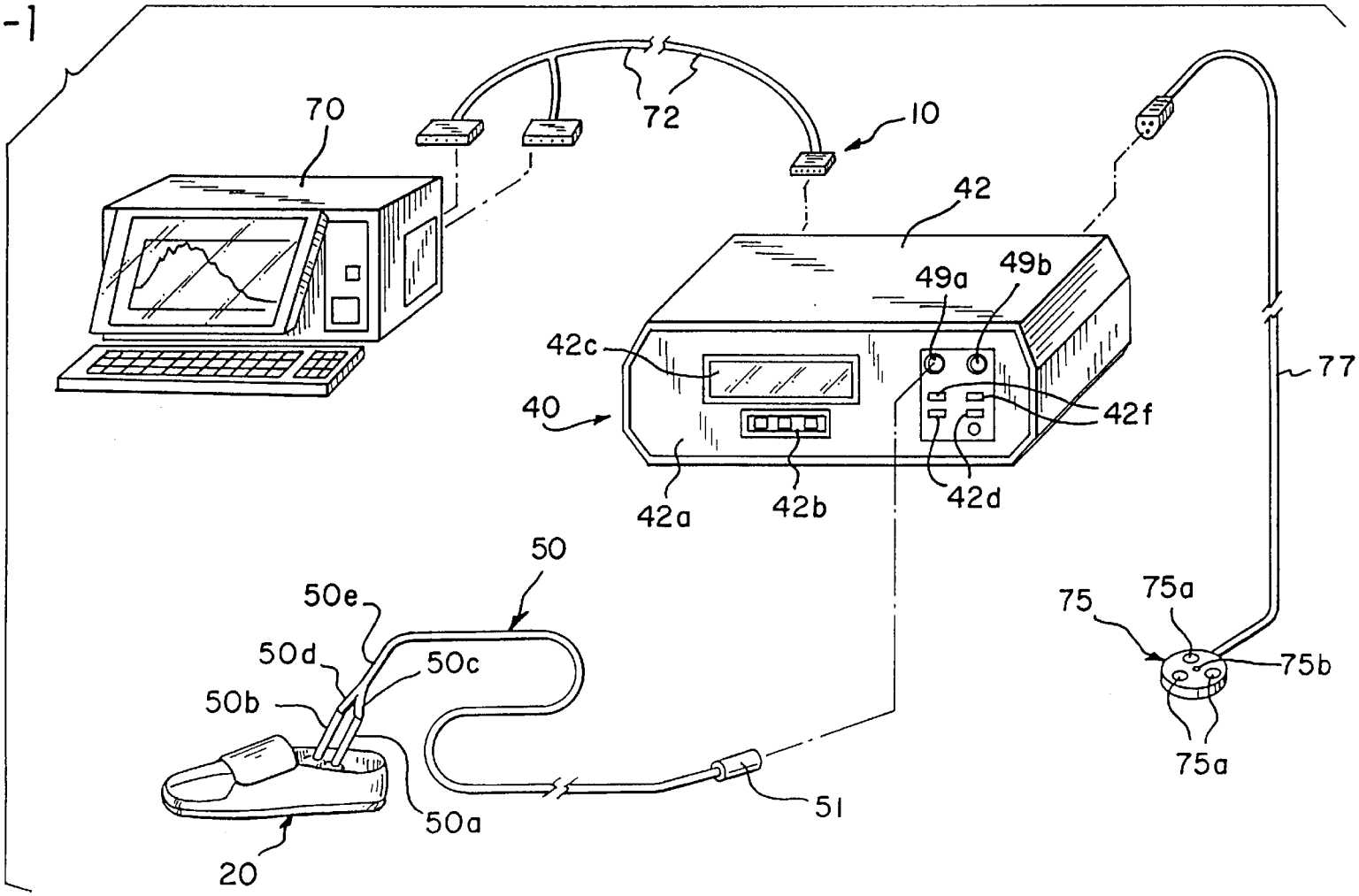
FIG. 1 is a perspective view of medical pumping apparatus constructed and operable in accordance with the present invention.

A medical pumping apparatus 10 constructed and operable in accordance with the present invention is shown in FIG. 1. The apparatus includes a boot 20 adapted to be fitted upon and secured to a patient's foot. The boot 20 is provided with an inflatable bag 30 (see FIGS. 2 and 4) which, when inflated, serves to apply compressive pressures upon the patient's foot to stimulate venous blood flow. The apparatus 10 further includes a fluid generator 40 which cyclically generates fluid pulses, air pulses in the illustrated embodiment, during periodic inflation cycles. The fluid pulses are communicated to the bag 30 via a first conducting line 50. The generator 40 also serves to vent fluid from the bag 30 to atmosphere during periodic vent or deflation cycles between the periodic inflation cycles.

Figure 2:
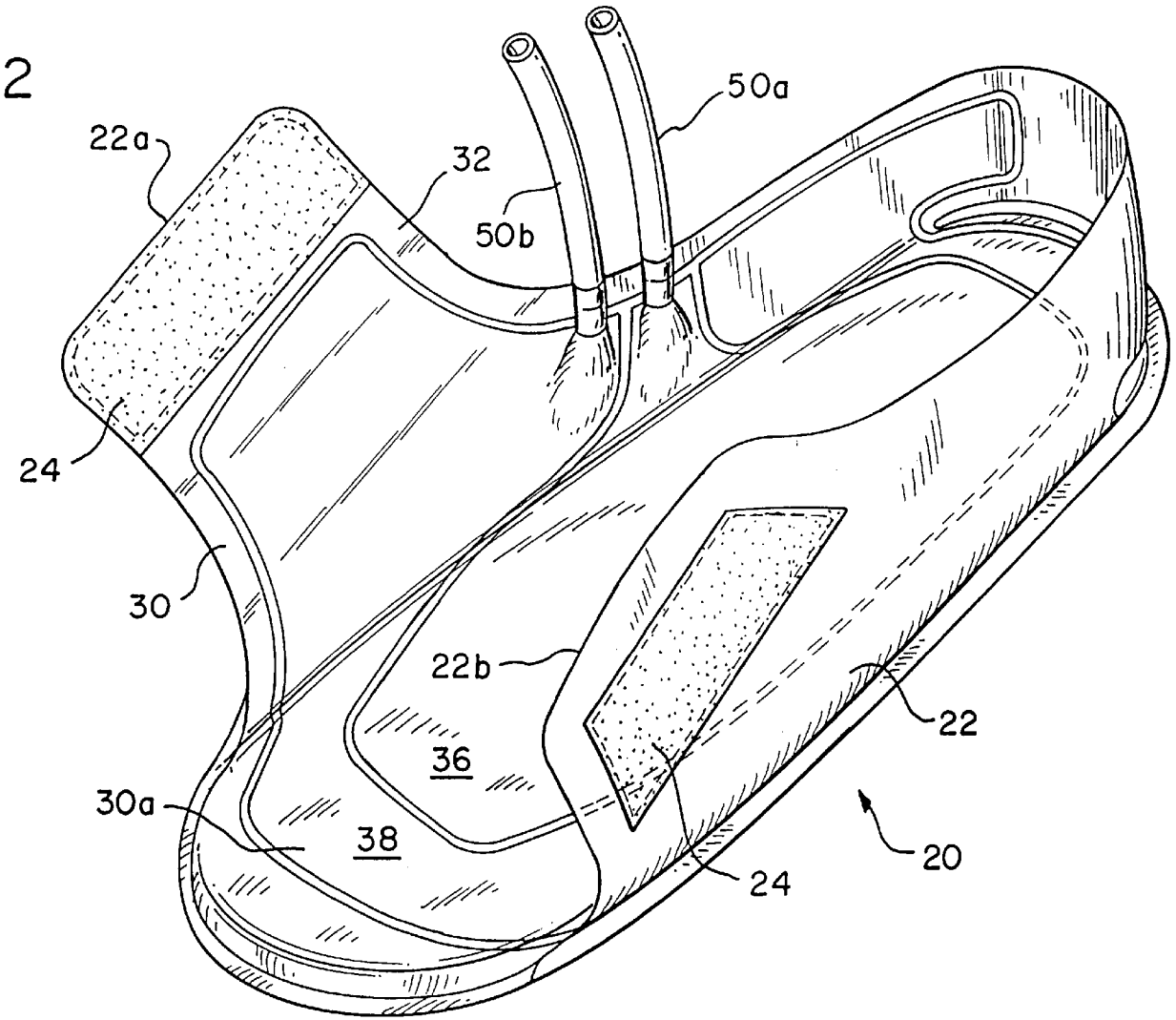
FIG. 2 is a perspective view of the boot and inflatable bag of the present invention.
Figure 3:
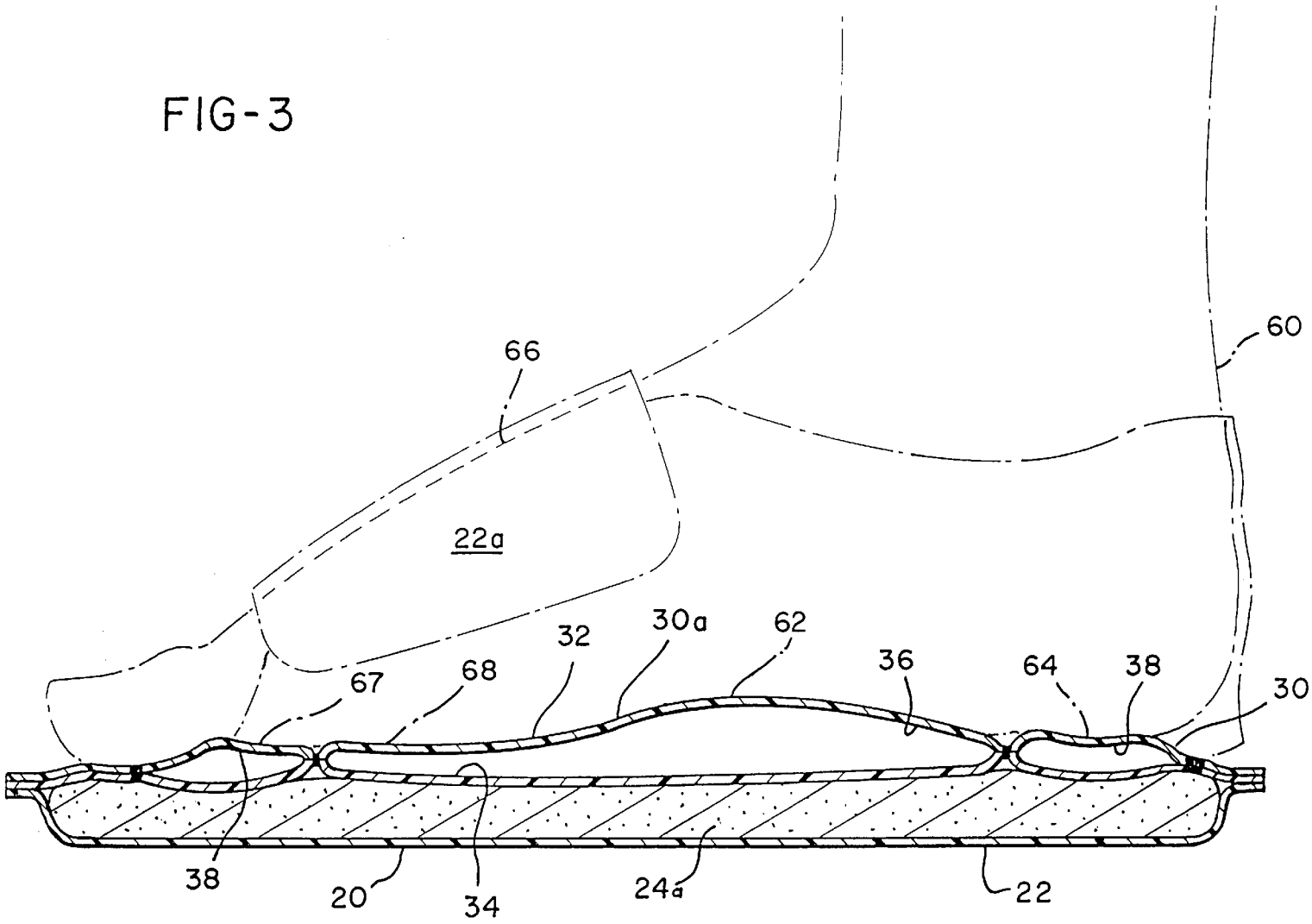
FIG. 3 is a cross-sectional view of the inflatable bag and the lower portion of the boot with the upper portion of the boot and a patient's foot shown in phantom.

Referring to FIGS. 2–5, the inflatable bag 30 is constructed from first and second panels 32 and 34 of flexible material such as polyurethane, polyvinyl chloride or the like. The panels 32 and 34 are heat sealed or otherwise secured to one another to form first and second fluid bladders 36 and 38, respectively. As best shown in FIG. 3, the first fluid bladder 36 engages a patient's foot 60 approximately at the plantar arch 62, which extends between the metatarsal heads and the heel 64. The second fluid bladder 38 engages the foot approximately at the dorsal aspect 66, the heel 64 and a forward portion 67 of the sole 68 of the foot 60 beneath toe phalanges. As should be apparent, the exact foot portions engaged by the two bladders will vary somewhat from patient to patient.

As best shown in FIGS. 2 and 3, the boot 20 comprises a flexible outer shell 22 made from a flexible material, such as vinyl coated nylon. The inflatable bag is placed within the shell 22 and is adhesively bonded, heat sealed or otherwise secured thereto. Interposed between the outer shell 22 and the inflatable bag 30 is a stiff sole member 24*a* formed, for example, from acrylonitrile butadiene styrene. The outer shell 22 is provided with first and second flaps 22*a* and 22*b* which, when fastened together, secure the boot 20 in a fitted position upon a patient's foot. Each of the flaps 22*a* and 22*b* is provided with patches 24 of loop-pile fastening material, such as that commonly sold under the trademark Velcro. The patches 24 of loop-pile material permit the flaps 22*a* and 22*b* to be fastened to one another. A porous sheet of lining material (not shown) comprising, for example, a sheet of polyester nonwoven fabric, may be placed over the upper surface 30*a* of the inflatable bag 30 such that it is interposed between the bag 30 and the sole 68 of the foot when the boot 20 is secured upon the foot 60.

Figure 6:
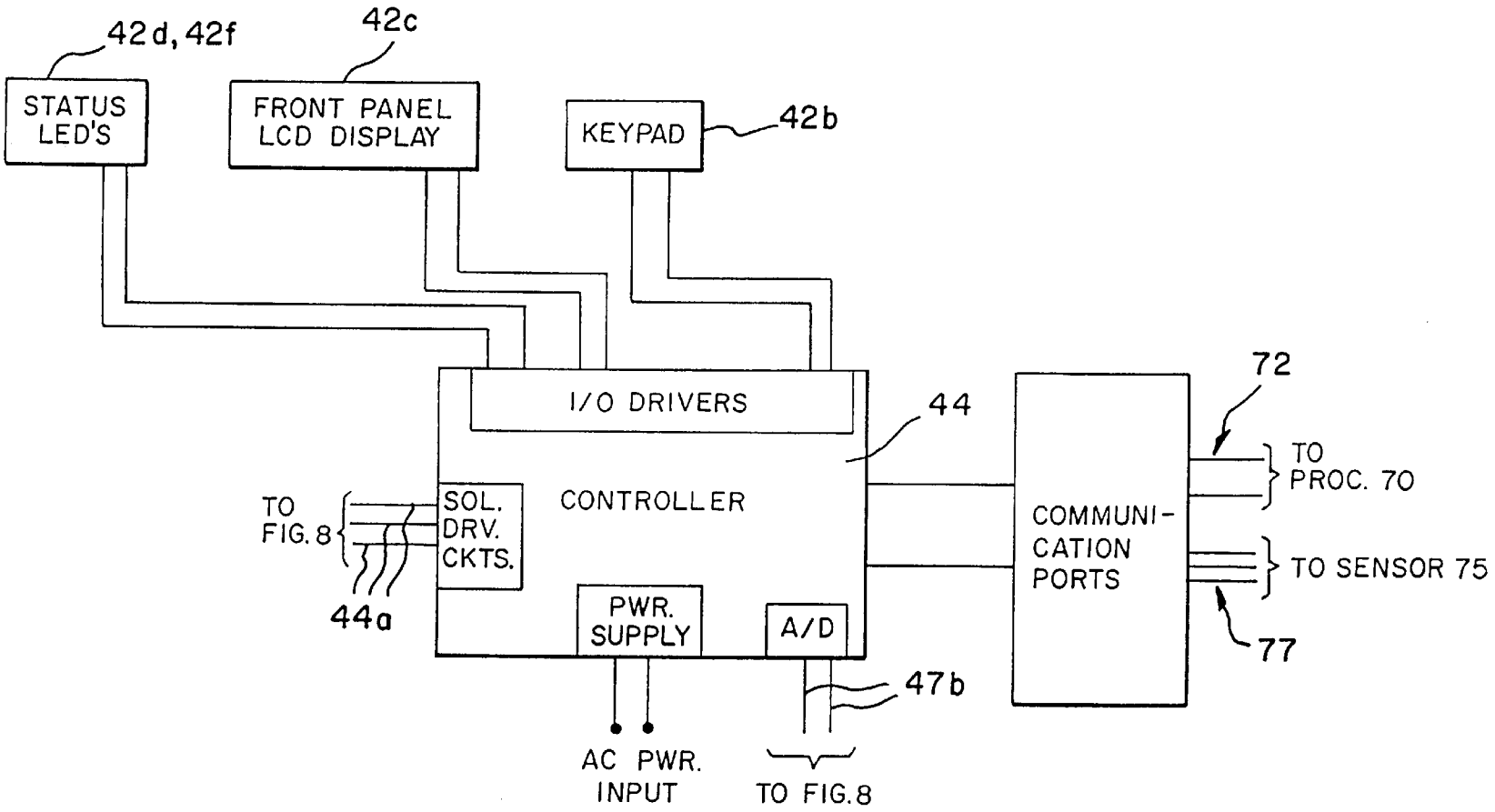
FIG. 6 is a schematic illustration of the controller of the fluid generator illustrated in FIG. 1.

The fluid generator 40 includes an outer case 42 having a front panel 42*a*. Housed within the outer case 42 is a controller 44 which is schematically illustrated in FIG. 6. The controller 44 stores an operating pressure value for the fluid pulses, an operating time period for the periodic inflation cycles and an operating time period for the periodic vent cycles. In the illustrated embodiment, the operating time period for the periodic inflation cycles is fixed at 3 seconds. The other two parameters may be varied.

Figure 7:
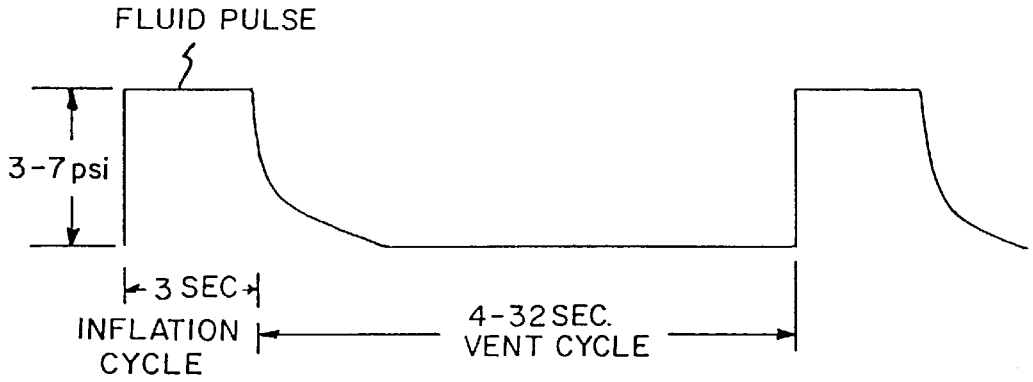
FIG. 7 is a graphical representation of an inflation cycle and vent cycle for an inflatable bag.

The front panel 42*a* of the outer case 42 is provided with a keypad 42*b* for setting a preferred pressure value to be stored by the controller 44 as the operating pressure value. By way of example, the preferred pressure value may be selected from a range varying from 3 to 7 psi. The keypad 42*b* is also capable of setting a preferred time period to be stored by the controller 44 as the operating time period for the periodic vent cycles. For example, the preferred vent cycle time period may be selected from a range varying from 4 to 32 seconds. As an alternative to setting a time period for just the vent cycles, a combined time period, determined by adding the time period for the inflation cycles with the time period for the vent cycles, may be set via the keypad 42*b* for storage by the controller 44. A graphical representation of an inflation cycle followed by a vent cycle for the inflatable bag 30 is shown in FIG. 7.

In the illustrated embodiment, a processor 70 is provided (e.g., at a physician's office) for generating a preferred pressure value for the fluid pulses and a preferred time period for the vent cycles. The processor 70 is coupled to the fluid generator 40 via an interface cable 72 and transmits the preferred pressure value and the preferred time period to the controller 44 for storage by the controller 44 as the operating pressure value and the operating time period. The processor 70 also transmits a disabling signal to the controller 44 to effect either partial or complete disablement of the keypad 42*b*. As a result, the patient is precluded from adjusting the operating pressure value or the operating time period or both via the keypad 42*b*, or is permitted to adjust one or both values, but only within predefined limits. An operator may reactivate the keypad 42*b* for setting new operating parameters (i.e., to switch from the processor input mode to the keypad input mode) by actuating specific keypad buttons in a predefined manner.

The controller 44 further provides for producing and saving patient compliance data (e.g., time, date and duration of each use by the patient), which data can be transmitted by the controller 44 to the processor 70 for storage by the same.

Figure 8:
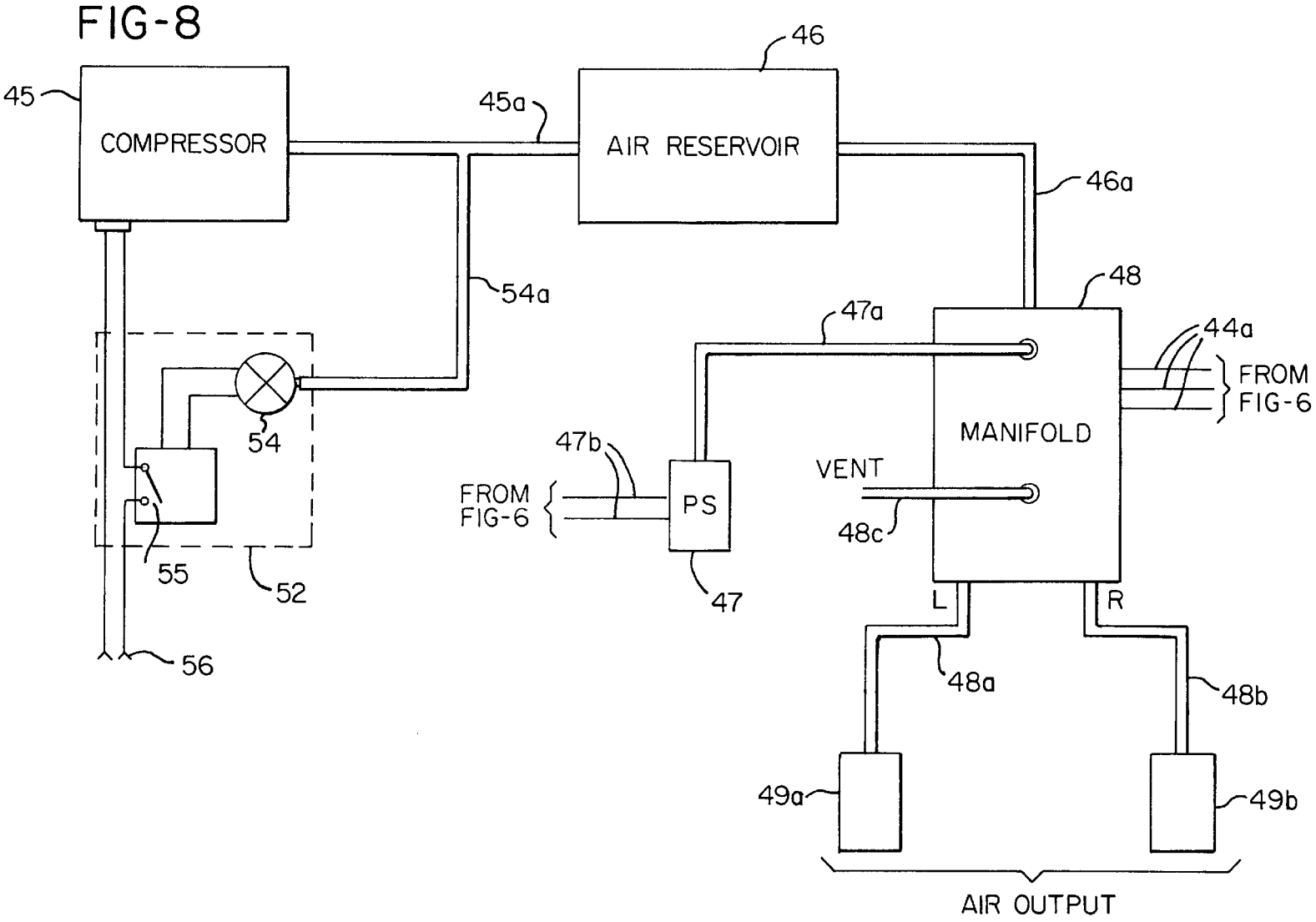
FIG. 8 is a block diagram of one embodiment of a compressor, air reservoir, manifold, pressure sensor and reservoir pressure control unit of the fluid generator illustrated in FIG. 1.

Further housed within the outer case 42 is an air compressor 45, an air reservoir 46, a pressure sensor 47, a reservoir pressure control unit 52 and a manifold 48, as shown in FIG. 8. Extending from the manifold 48 are left and right fluid lines 48*a* and 48*b* which terminate at left and right fluid outlet sockets 49*a* and 49*b*. The left fluid socket 49*a* extends through the front panel 42*a* of the outer case 42 for engagement with a mating connector 51 located at the proximal end of the conducting line 50, see FIG. 1. The conducting line 50 is secured at its distal end to the inflatable bag 30. The right socket 49*b* likewise extends through the front panel 42*a* for engagement with a mating connector located at the proximal end of a second conducting line (not shown) which is adapted to be connected at its distal end to a second inflatable bag (not shown).

The compressor 45 is preferably a small electrically powered air compressor. Compressed air generated by the compressor 45 is supplied to the reservoir 46 for storage via fluid line 45*a*. The reservoir 46 communicates with the manifold 48 via a fluid line 46*a*. In the past, the compressor 45 ran continuously during the operation of the medical pumping apparatus 10 to maintain the air pressure in the reservoir 46 at or above a desired minimum level and to insure that the manifold 48 was always supplied with the necessary air pressure. It has been found that the compressor 45 need not be operated continuously in order to insure that the necessary air pressure will be available. On the contrary, the compressor 45 can be operated periodically. For example, in the specific embodiment of the medical pumping apparatus 10, described in detail here, the compressor 45 runs only when the air pressure in the reservoir 46 drops below a preset lower level.

The operation of the compressor 45 is controlled by the reservoir pressure control unit 52. In this embodiment, the pressure control unit 52 operates independently of the controller 44 and the processor 70, but unit 52 could be otherwise designed. For example, the pressure control unit 52 could be incorporated into the processor 70. The control unit 52 basically includes a fluid pressure sensor 54 of mechanical or electrical design for sensing the air pressure in the reservoir 46. The fluid pressure sensor 54 is in fluid communication with the fluid line 45*a* between the compressor 45 and the reservoir 46 through a fluid line 54*a*, forming a "T" or "Y" connection therewith. Thus, through the line 54*a*, the sensor 54 samples the air pressure in line 45*a*, which is representative of the air pressure in the reservoir 46. The sensor 54 is interconnected to a control switch 55 operatively disposed between the motor of the compressor 45 and its source of power, such as a standard 115 VAC electrical outlet 56. Depending on its design, the sensor 54 can be connected to the switch 55 either electrically or mechanically.

The reservoir pressure control unit 52 is operatively adapted so that the switch 55 electrically connects the motor of the compressor 45 with the motor's source of power 56, when the pressure in the reservoir 46 is below the preset lower level. The compressor 45 then turns on and begins increasing the air pressure in the reservoir 46. This increase in air pressures is constantly being monitored by the pressure sensor 54. Once the air pressure in the reservoir 46 reaches or exceeds a preset high level, the sensor 54 causes the switch 55 to open, which disconnects the motor of the compressor 45 from its power source 56 and causes the compressor 45 to stop pumping. As long as the air pressure in the reservoir 46 remains above the lower level, the compressor 45 will remain off. The pressure in reservoir 46 falls below the preset lower limit after enough of the pressurized air is utilized by apparatus 10 to inflate one or more of the bladders 36 and 38. Once the air pressure in the reservoir 46 drops below this lower level, the compressor 45 will start pumping again and the cycle described above will repeat itself for as long as the medical pumping apparatus 10 continues to be operated.

This technique of automatically cycling (i.e., duty cycling) the compressor 45 on and off by the pressure levels in the reservoir 46 can allow the compressor 45 to rest up to ⅔ of the time that the pumping apparatus 10 is in use. Duty cycling the compressor 45 greatly increases the life span of the compressor 45 and reduces the maintenance the compressor 45 may require during its service life. The life span of the motor of compressor 45, like other electric motors, can be adversely impacted by heat build-up, which is often exacerbated by continuous use. As is well known, a cooling fan (not shown) can be used to cool-off the compressor 45 when it is run continuously. However, by cycling the compressor 45 according to the principles of the present invention, it is believed that any need for such a fan can be eliminated, or at least a smaller fan can be used.

Figure 8A:
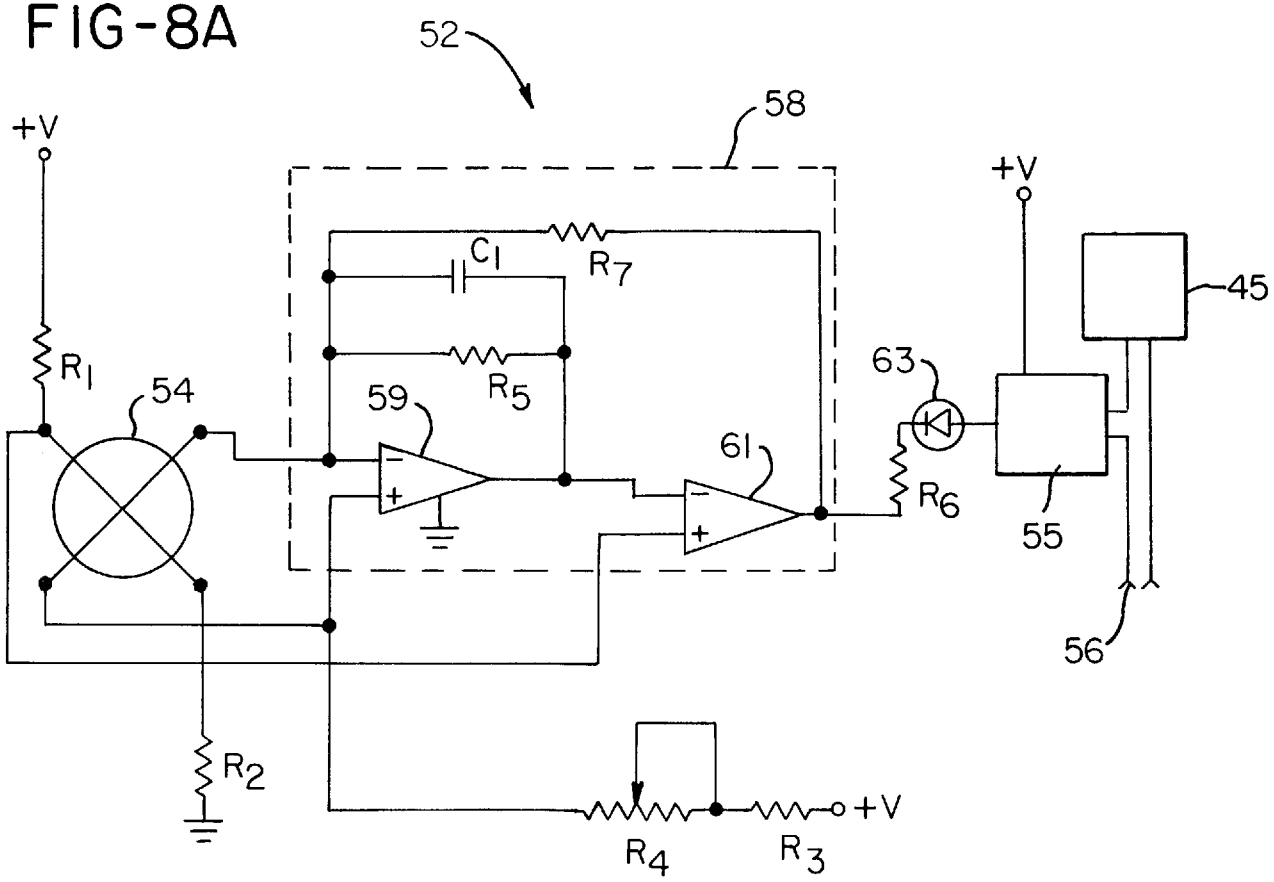
FIG. 8A is a schematic diagram of one embodiment of the reservoir pressure control unit illustrated in FIG. 8.

Referring to FIG. 8A, one specific embodiment of the reservoir pressure control unit 52, that is adapted to operate as above described, is supplied with 12 Volts DC at the points indicated by the reference symbol +V. This specific pressure control unit 52 includes an air pressure sensor 54 in the form of a transducer, such as that manufactured by Motorola, part no.: MPX-100 or MPX-200. Two 820 ohms resistors $R_1$ and $R_2$ connect the power supply to the pressure transducer 54 to provide increased linearity for the control unit 52 over a wider temperature range, and thereby minimize the error in pressure readings caused by temperature variations.

In response to the air pressure in the line 54*a*, the transducer 54 transmits an electrical signal, representative of the pressure in the reservoir 46. This electrical pressure signal is transmitted through an integrated circuit 58 which has both an amplifier 59 and a comparator 61 with hysteresis, such as the LT-1078 (dual) or half of the LM-324 (quad) operational amplifier manufactured by National Semiconductor. The non-inverting input of the amplifier 59 is connected to the reference voltage +V through a 33 Kohm resistor $R_3$ connected in series with a 50 Kohm variable resistor or potentiometer $R_4$. The potentiometer $R_4$ is used to set the offset of the amplifier 59, and hence, the sensitivity or high pressure trip-level of the control unit 52. The gain of the amplifier 59 is set by a 100 Kohm resistor $R_5$ and the output impedance of the transducer 54. The impedance of the transducer 54 is nominally 1000 ohms. Thus, the gain for this stage is approximately 100,000/1000 or 100. A 0.10 $\mu$f capacitor $C_1$ is connected in parallel with resistor $R_5$ to prevent high frequency noise or oscillations from creating related problems for the control unit 52.

When the signal on the inverting input of the comparator 61 exceeds the level of its reference voltage connected to its non-inverting input, the output of the comparator 61 exhibits a negative transition from a high logic state to a low logic state. When this negative transition occurs, current flows through the control switch 55, such as a solid state AC voltage relay PS2401, manufactured by CP Claire Corp., Wakefield, Mass., a light emitting diode 63 and a 1.1 Kohm resistor $R_6$. The relay switch 55 controls the connection of the 115 VAC line power from outlet 56 to the motor of compressor 45. The negative or high-to-low transition from the comparator 61 serves to turn on the relay switch 55 and allow power to reach the compressor 45. A 910 Kohm resistor $R_7$ provides a measure of hysteresis for the circuit 58, providing a dual trip-point to prevent the control unit 52 from oscillating.

When the compressor 45 is of the type rated for 12 VDC, such as that manufactured by the company Medo, Hanover Park, Ill., part no.: AC 0110-A1053-D2-0511, the compressor 45 and the pressure control unit 52 can be powered from the same 12 VDC supply. In such a case, the 115 VAC is transformed to the 12 VDC in a conventional manner, and the switch 55 still controls the power to compressor 45. In this embodiment, the diode 63 operates as a troubleshooting light. If light is generated by the diode 63, then the motor of the compressor 45 should also be running. The control switch 55 could also be a light activated solid state relay which is optically coupled to a light emitting diode.

When the pressure in the air reservoir 46, as measured by the transducer 54, falls below an "on" trip-point, the comparator 61 switches to a low level output. When the comparator 61 switches low, the solid state relay 55 is activated, which causes the compressor 45 to turn on. The compressor 45 then begins pumping air into the reservoir 46, restoring the desired pressure level. The applied pressure increases until the comparator 61 switches to a high level output. The hysteresis resistor $R_7$ can be varied to provide hysteresis ranging from about 1% to about 49% of the trip-point value.

With this dual trip-point scheme, after the pressure in reservoir 46 exceeds the "on" trip-point, the compressor 45 continues to run, building the pressure in reservoir 46 until a second "off" trip-point is reached. At this point, the relay switch 55 is deactivated and power to the compressor 45 turned off. A slight amount of pressure typically leaks from the air delivery system. However, even if the pressure falls below the point where the compressor 45 was just turned off, the control unit 52 will not turn the compressor 45 back on again until the "on" trip-point is reached. This prevents oscillation of the control unit 52 which would cause excessive cycling, defeating the purpose of the control unit 52 to effect a controlled duty cycling of the compressor 45.

The trip-point can be varied by adjusting the variable resistor $R_4$. Adjusting resistor $R_4$ causes a voltage division between the wiper $R_4$ and the transducer 54 takes place. When amplified, this voltage division establishes a DC offset or pedestal level for the output of the amplifier 59. For the embodiment disclosed, this DC offset varies, for example, from about 0 to about 5 VDC. Typically, each circuit 58 has to be calibrated for each transducer 54. By observing the polarity of the transducer output and op-amp circuits, it can be seen that the amplifier output will go toward ground with an increase in pressure. The positive value at which the amplifier 59 starts its high-to-low transition is determined by the setting of the wiper resistor $R_4$. Therefore, the wiper resistor $R_4$ establishes the pedestal level from which the negative transition begins.

Using the Medo compressor 45 described above, it has been found desirable to preset the lower pressure level at about 12 psi. The National Semiconductor amplifier/comparator 58, described above, has a deadband in the range of about 1–4 psi and typically about 1.5 psi. Thus, with this amplifier/comparator 58, the relay switch 55 turns the compressor 45 on at a pressure of about 12 psi and turns the compressor 45 off at a pressure of about 13.5 psi.

Figure 8B:
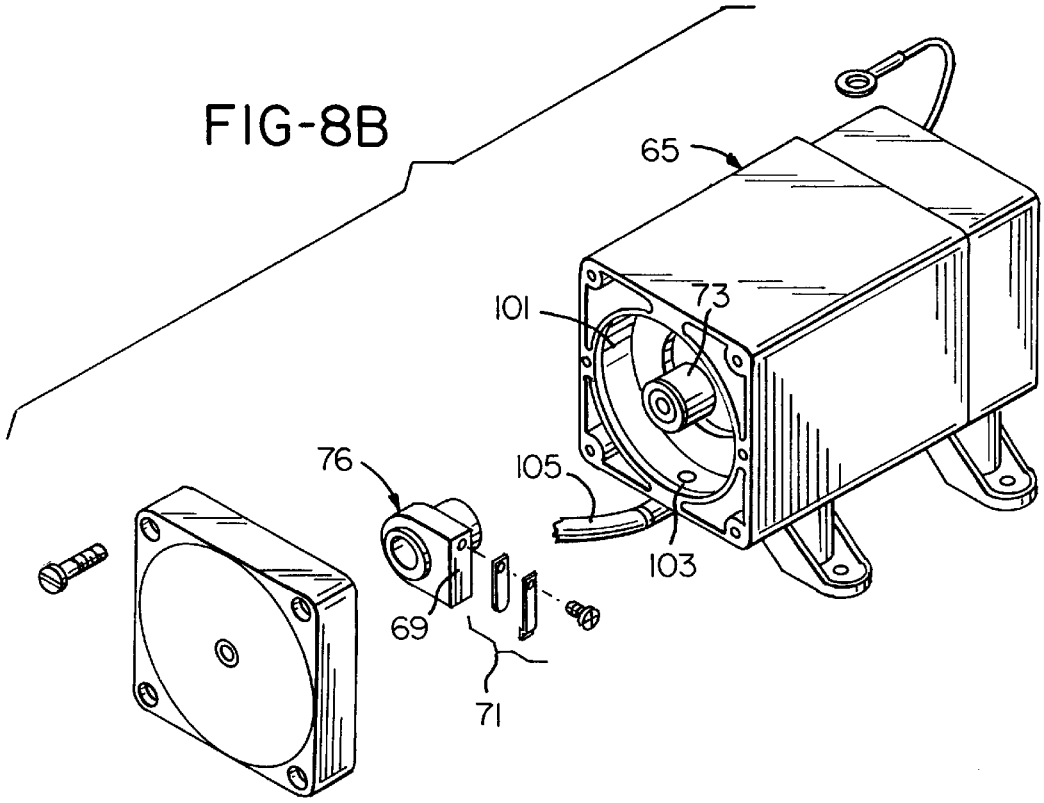
FIG. 8B is a partially exploded perspective view of one example of a compressor which can be used in the fluid generator of FIG. 8.
Figure 8C:
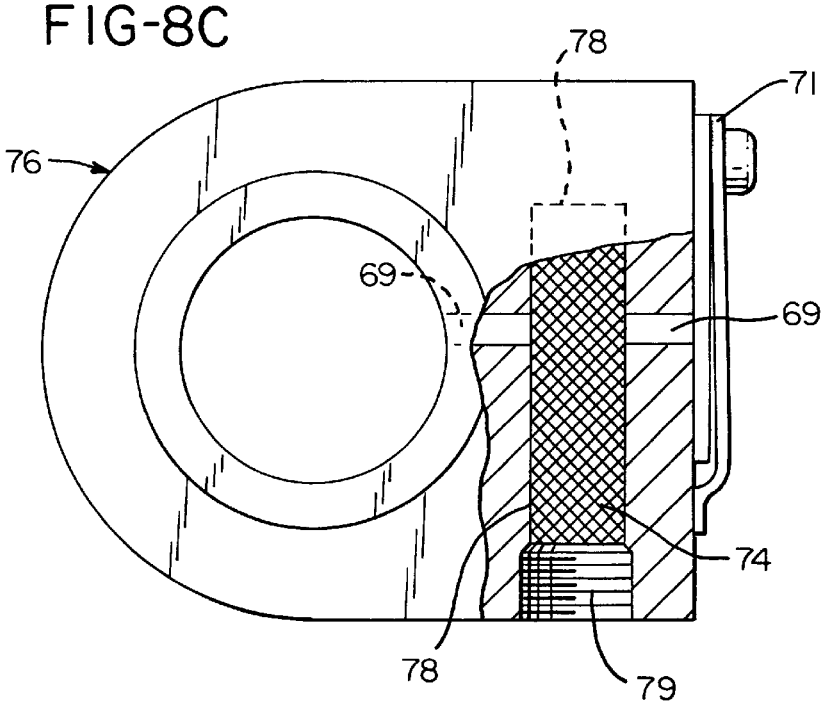
FIG. 8C is an enlarged and partially sectioned plan view of the reed valve assembly used in the compressor of FIG. 8B.

Referring to FIGS. 8B and 8C, a Medo air compressor 65, like the one described above, includes an air exhaust port 69 and valve 71, and a TEFLON coated piston 73. Piston 73 draws air in through an intake port (not shown) and forces air out through the exhaust port 69, past valve 71, into a sealed air chamber 101 and out a pump outlet port 103 to the air reservoir 46 through an air outlet tube 105 connected to the air line 45*a*. An intake filter (not shown) is disposed in the path of the air passing through the intake port (not shown). The exhaust port 69 and valve 71 used with this particular Medo compressor 65 forms part of a reed valve assembly 76. It has been discovered that a Medo compressor 65, like that described above, can be run continuously for longer periods of time without having to be serviced or replaced by disposing an exhaust filter 74 in the path of the exhaust port 69 so as to filter the air before it is forced out through the reed valve 71.

The exhaust filter 74 can be disposed in the path of the exhausted air in a number of ways, according to the present invention, including drilling or otherwise forming a bore hole 78, in the assembly 76, transverse to and cutting completely through the previously continuous exhaust port 69, before the reed valve 71 (see FIG. 8C). The exhaust filter 74 is disposed in the bore hole 78 so that any air exiting the compressor 65 has to pass through the filter 74 before being exhausted out through the reed valve 71. The bore hole 78 can be up to about 5 times or more as large in diameter and/or up to about 3 times or more as long as the exhaust port 69. The open end of the hole 78 is plugged, such as with a threaded cap 79, to keep the filter 74 in place. The threaded cap 79, and any other means for plugging hole 78, is preferably air tight so that all the generated air pressure passes through the filter material 74 and out past the reed valve 71.

It appears that this exhaust filter 74 significantly prevents dust and other particulate, coming from inside the compressor 65 (e.g., wear particles generated by the action of the piston 73), from reaching the reed valve 71. The output of the Medo compressor 65 drops significantly as such particulate accumulates on the reed valve 71. It has been found that by using an exhaust filter 74, the life span of a continuously run Medo compressor 65, or any similar compressor, can be extended by a significant amount. It is believed that the life span of a Medo compressor 65, or any similar compressor, can be extended by as much as 4 to 5 times or even more. Satisfactory results have been obtained by using the same filter material for the exhaust filter 74 as is used for the intake filter (not shown) of the above described type of Medo compressor 65. This filter material is an open cell foam with small cells and can be obtained from Medo. It is believed desirable to use such an exhaust filter 74 on any compressor 45 having any type of exhaust valve 71 which is sensitive to particulate accumulation.

An inflate solenoid, a vent solenoid, a channel solenoid and associated valves are provided within the manifold 48. The inflate solenoid effects the opening and closing of its associated valve to control the flow of fluid into the manifold 48 from the air reservoir 46 via fluid line 46*a*. The vent solenoid effects the opening and closing of its associated valve to control the flow of fluid from the manifold 48 to atmosphere via a vent line 48*c*. The channel solenoid effects the opening and closing of its associated valve to control the flow of fluid from the manifold 48 to fluid line 48*a* or fluid line 48*b*.

Actuation of the solenoids is controlled by the controller 44, which is coupled to the solenoids via conductors 44*a*. During inflation cycles, the controller 44 actuates the vent solenoid to prevent the venting of fluid in the manifold 48 to atmosphere via vent line 48*c*. The controller 44 further actuates the inflate solenoid to allow pressurized air to pass from the air reservoir 46, through the manifold 48 to either the fluid line 48*a* or the fluid line 48*b*.

During vent cycles, the controller 44 initially causes the inflate solenoid to stop pressurized fluid from passing into the manifold 48 from the reservoir 46. It then causes the vent solenoid to open for at least an initial portion of the vent cycle and vent the fluid in the manifold 48 to atmosphere.

Depending upon instructions input via the keypad 42*b* or the processor 70, the controller 44 also serves to control, via the channel solenoid, the flow of fluid to either line 48*a* or line 48*b*. If only a single boot 20 is being employed, the processor 70 does not activate the channel solenoid and line 48*a*, which is normally in communication with the manifold 48, communicates with the manifold 48 while line 48*b* is prevented from communicating with the manifold 48 by the valve associated with the channel solenoid. If two boots 20 are being employed, the controller 44 activates and deactivates the channel solenoid to alternately communicate the lines 48*a* and 48*b* with the manifold 48, thereby simulating walking. As should be apparent, when two boots 20 are used in an alternating manner, each boot will have its own separate inflation and vent cycles. Thus, during the vent cycle for the bag 30, an inflation cycle takes place for the other bag (not shown). The inflate solenoid allows pressurized fluid to pass from the air reservoir 46, through the manifold 48 and into the fluid line 48*b* associated with the other bag, while the channel solenoid has been activated to prevent communication of the fluid line 48*a* associated with the bag 30 with the manifold 48.

The air pressure sensor 47 communicates with the manifold 48 via an air line 47*a* and senses the pressure level within the manifold 48, which corresponds to the pressure level which is applied to either the fluid line 48*a* or the fluid line 48*b*. The pressure sensor 47 transmits pressure signals to the controller 44 via conductors 47*b*. Based upon those pressure signals, the controller 44 controls the operation of the inflate solenoid, such as by pulse width modulation or otherwise. Pulse width modulation for this application comprises activating the inflate solenoid for one pulse per cycle, with the pulse lasting until the desired pressure is achieved. The length of the pulse is based upon an average of the fluid pressure level during previous inflation cycles as measured by the pressure sensor 47. Pulse length and hence pressure level is iteratively adjusted in small steps based on each immediately preceding pulse. In this way, the fluid pressure within the manifold 48, and thereby the pressure which is applied to either fluid line 48*a* or fluid line 48*b*, is maintained substantially at the stored operating pressure value with no sudden changes in pressure level.

In an alternative embodiment, the pressure sensor 47 is replaced by a force sensor (not shown) secured to the bag 30 so as to be interposed between the first bladder 36 and the sole 68 of the foot 60. The force sensor senses the force applied by the bladder 36 to the foot 60 and transmits force signals to the controller 44 which, in response, controls the operation of the inflate solenoid to maintain the fluid pressure within the manifold 48, and thereby the pressure which is applied to either fluid line 48*a* or fluid line 48*b*, at the stored operating pressure level.

Figure 4:
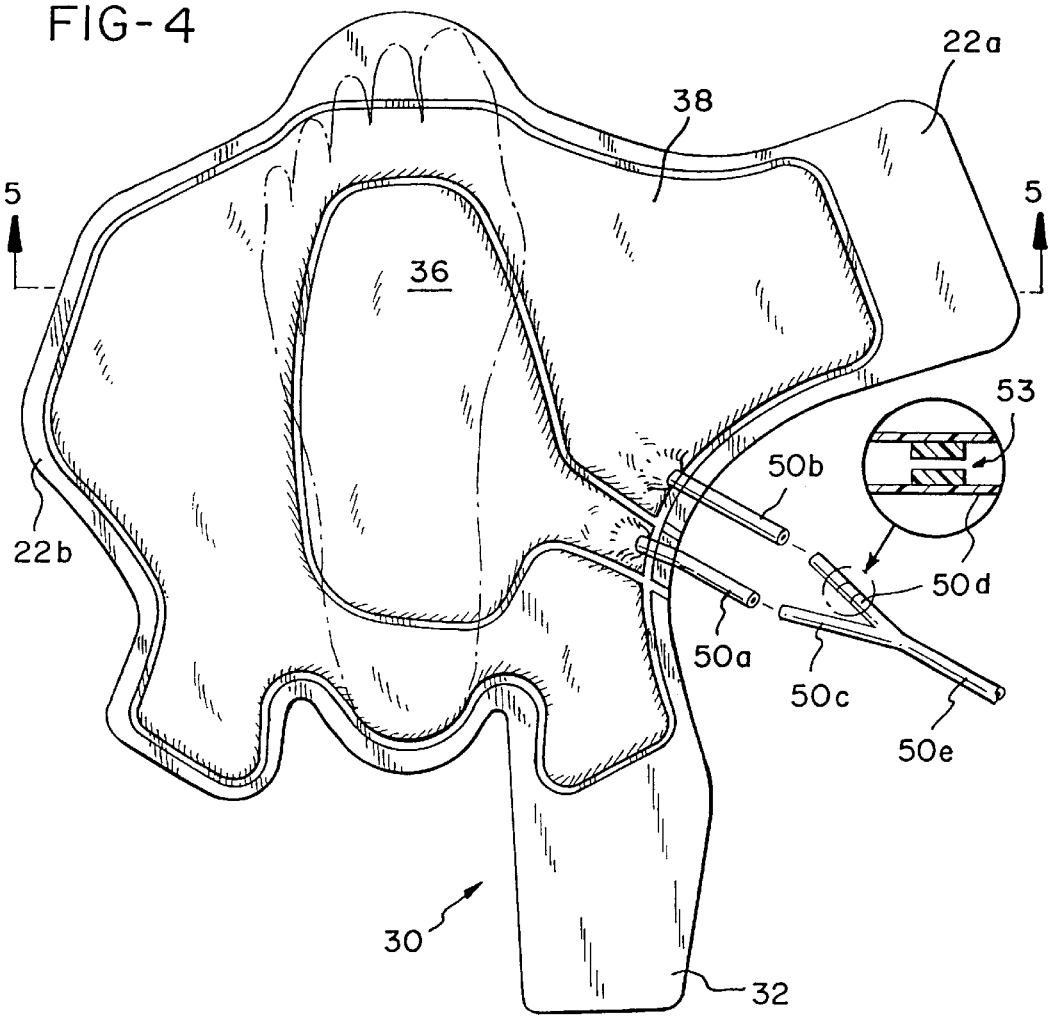
FIG. 4 is a plan view of the inflatable bag shown in FIG. 2 and illustrating in phantom a patient's foot positioned over the inflatable bag.
Figure 5:
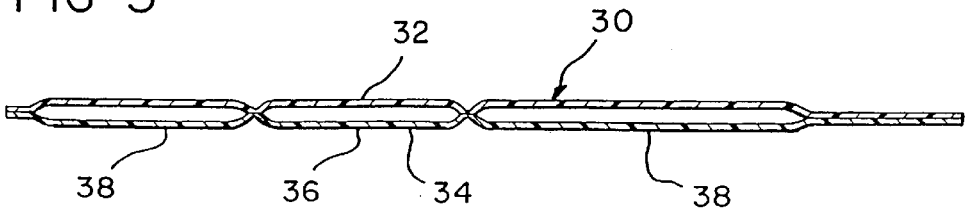
FIG. 5 is a cross-sectional view taken along section line 5—5 in FIG. 4.

In the embodiment illustrated in FIGS. 1, 2 and 4, the conducting line 50 comprises a first tubular line 50*a* connected at its distal end to the first bladder 36, a second tubular line 50*b* connected at its distal end to the second bladder 38, a third tubular line 50*c* connected at its distal end to a proximal end of the first tubular line 50*a*, a fourth tubular line 50*d* connected at its distal end to a proximal end of the second tubular line 50*b*, and a fifth tubular line 50*e* integrally formed at its distal end with proximal ends of the third and fourth tubular lines 50*c* and 50*d*. The fourth tubular line 50*d* is provided with a restrictive orifice 53 for preventing delivery of fluid into the second bladder 38 at the same rate at which fluid is delivered into the first bladder 36. More specifically, the restrictive orifice 53 is dimensioned such that the fluid pressure in the first bladder 36 is greater than the fluid pressure level in the second bladder 38 during substantially the entirety of the inflation cycle.

Figure 4A:
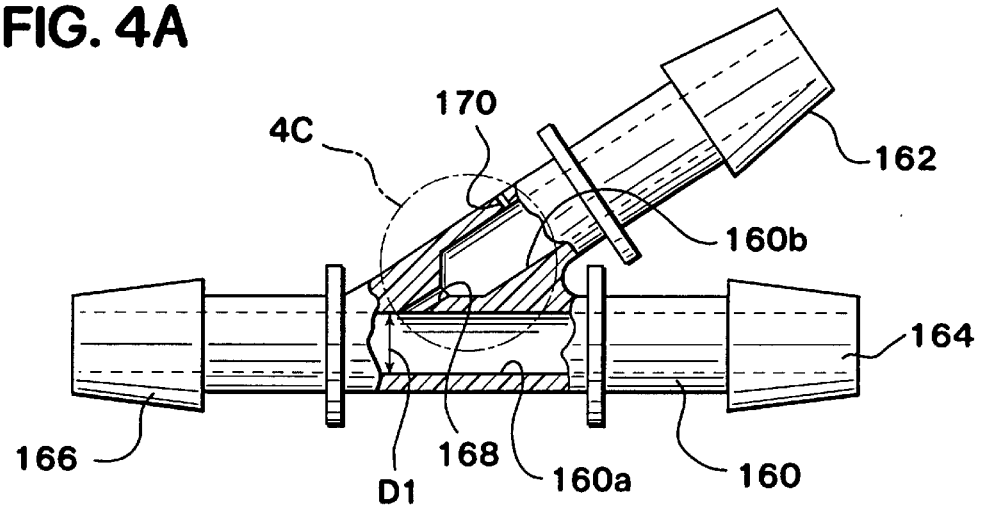
FIG. 4A is a side view, partially in cross-section, of a Y-connector forming part of a conducting line constructed in accordance with a second embodiment of the present invention.
Figure 4B:
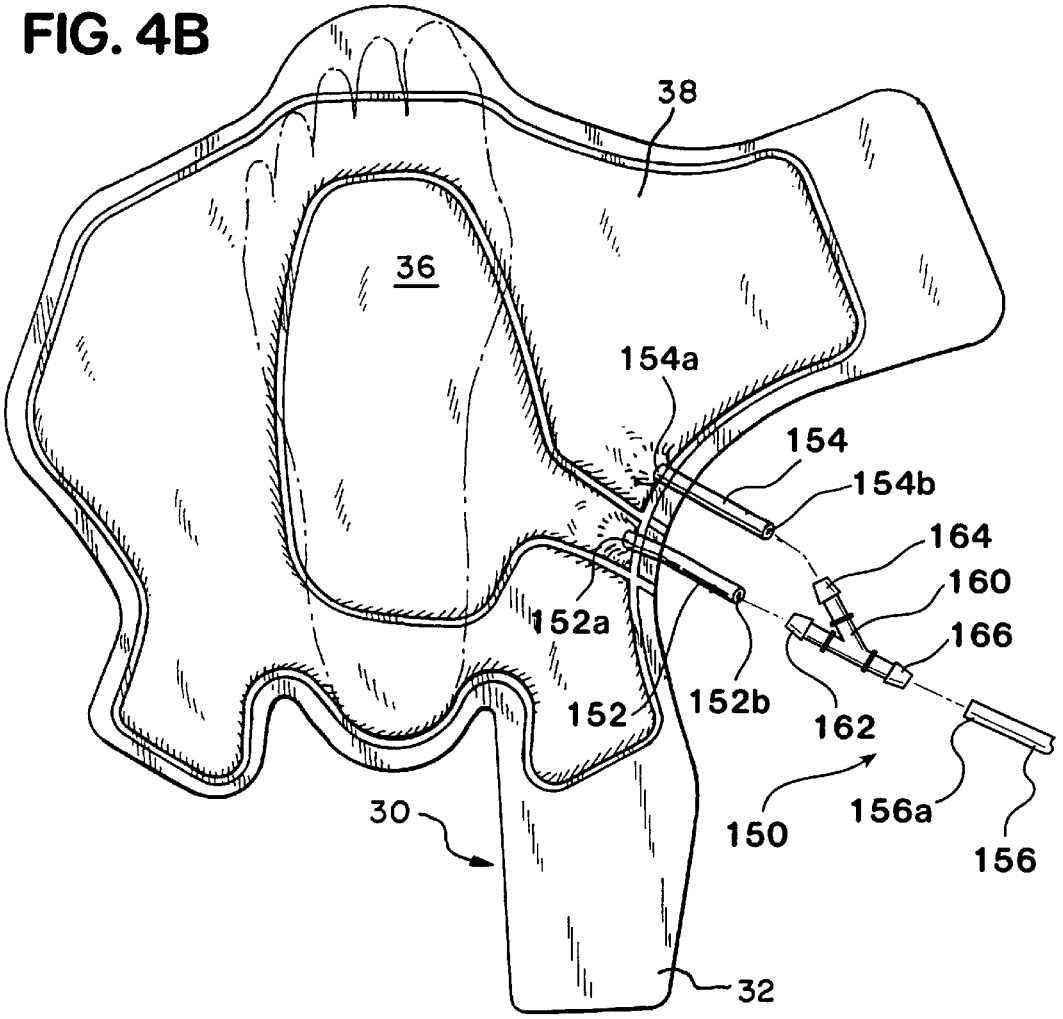
FIG. 4B is a plan view of an inflatable bag and a portion of a conducting line constructed in accordance with the second embodiment of the present invention.

A conducting line 150 and inflatable bag 30, formed in accordance with a second embodiment of the present invention, are shown in FIG. 4B, where like reference numerals indicate like elements. In this embodiment, the conducting line 150 (also referred to herein as a fluid conductor) comprises a first tubular line 152 connected at its distal end 152*a* to the first bladder 36, a second tubular line 154 connected at its distal end 154*a* to the second bladder 38, a Y-connector 160 connected at its first distal end 162 to a proximal end 152*b* of the first tubular line 152 and at its second distal end 164 to a proximal end 154*b* of the second tubular line 154, and a third tubular line 156 connected at its distal end 156*a* to a proximal end 166 of the Y-connector 160. The Y-connector 160 further includes a restrictive orifice 168 for preventing delivery of fluid into the second bladder 38 at the same rate at which fluid is delivered into the first bladder 36, see FIGS. 4A and 4C. The restrictive orifice 168 is dimensioned such that the fluid pressure in the first bladder 36 is greater than the fluid pressure level in the second bladder 38 during substantially the entirety of the inflation cycle. The proximal end of the third tubular line 156 is provided with a mating connector (not shown) which is substantially similar to mating connector 51 described above.

Figure 4C:
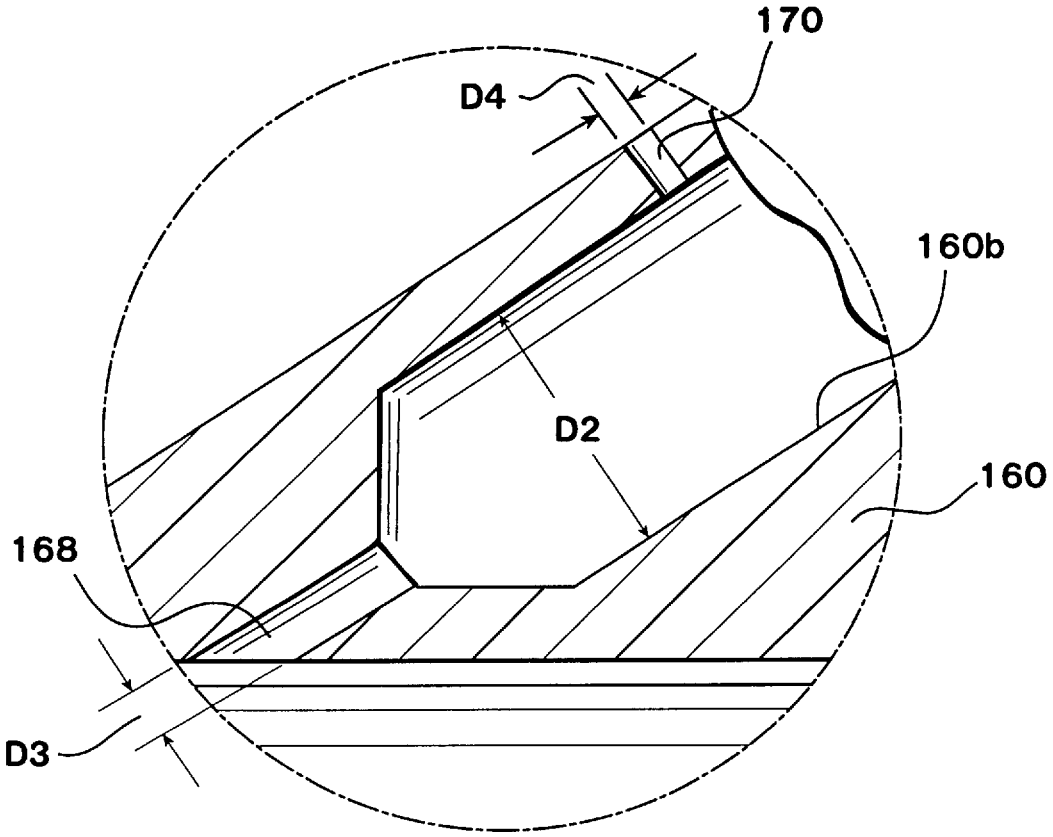
FIG. 4C is an enlarged view of a portion of the Y-connector shown in FIG. 4A.

A safety vent port 170 is provided in the Y-connector 160, see FIGS. 4A and 4C. Should a power failure occur during an inflation cycle with the vent valve in its closed position, pressurized fluid within the first and second bladders 36 and 38 will slowly decrease with time due to venting of the pressurized fluid through the safety vent port 170. The vent port 170 also serves to vent pressurized fluid to atmosphere in the unlikely event that the fluid generator 40 malfunctions such that the fluid generator inflate and vent solenoids and associated valves permit unrestricted flow of pressurized fluid into the bag 30.

Referring to FIGS. 4A and 4C, an example Y-connector 160 formed in accordance with the second embodiment of the present invention will now be described. The passage 160*a* of the Y-connector 160 has an inner diameter $D_1$=0.09 inch. The passage 160*b* has an inner diameter $D_2$=X inch. The restrictive orifice 168 has an inner diameter $D_3$=0.020 inch. The vent port 170 has an inner diameter $D_4$=0.013 inch. Of course, the dimensions of the Y-connector passages 160*a* and 160*b*, the restrictive orifice 168 and the vent port 170 can be varied in order to achieve desired inflation and vent rates.

Figure 4D:
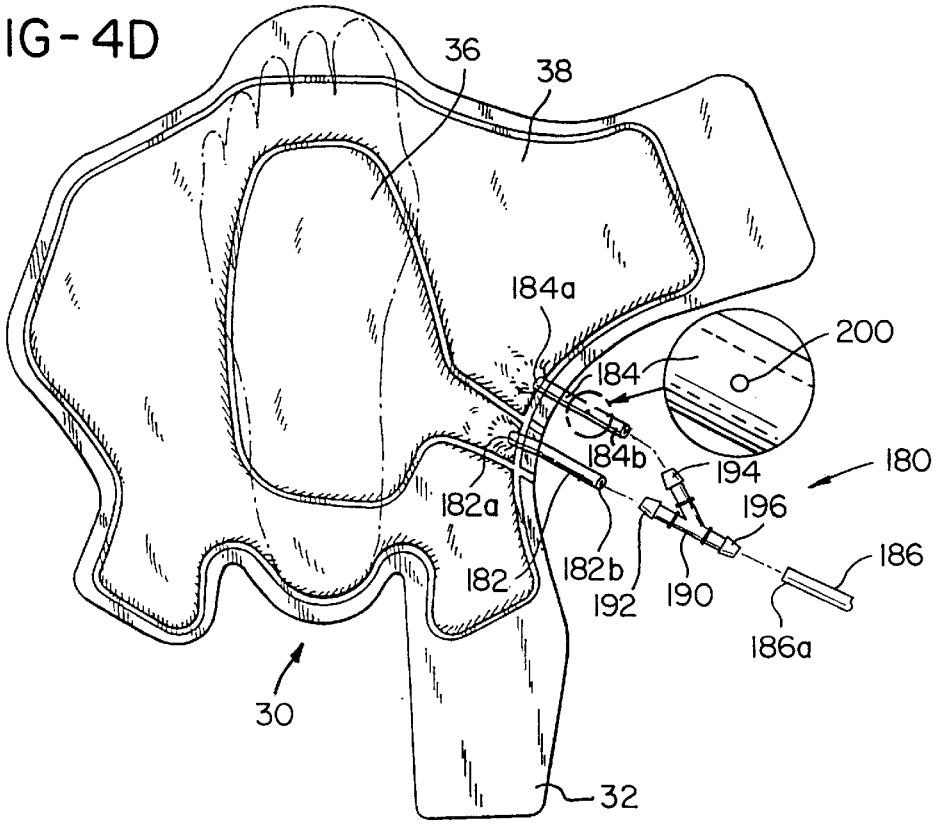
FIG. 4D is a plan view of an inflatable bag and a portion of a conducting line constructed in accordance with a third embodiment of the present invention.

A conducting line 180 and inflatable bag 30, formed in accordance with a third embodiment of the present invention, are shown in FIG. 4D, where like reference numerals indicate like elements. In this embodiment, the conducting line 180 (also referred to herein as a fluid conductor) comprises a first tubular line 182 connected at its distal end 182*a* to the first bladder 36, a second tubular line 184 connected at its distal end 184*a* to the second bladder 38, a Y-connector 190 connected at its first distal end 192 to a proximal end 182*b* of the first tubular line 182 and at its second distal end 194 to a proximal end 184*b* of the second tubular line 184, and a third tubular line 186 connected at its distal end 186*a* to a proximal end 196 of the Y-connector 190. The Y-connector 190 further includes a restrictive orifice (not shown) which is substantially similar to restrictive orifice 168 shown in FIGS. 4A and 4C. The restrictive orifice is dimensioned such that the fluid pressure in the first bladder 36 is greater than the fluid pressure level in the second bladder 38 during substantially the entirety of the inflation cycle. A safety vent port 200 is provided in the first tubular line 182 and functions in substantially the same manner as vent port 170 described above. The proximal end of the third tubular line 186 is provided with a mating connector (not shown) which is substantially similar to mating connector 51 described above.

Figure 4E:
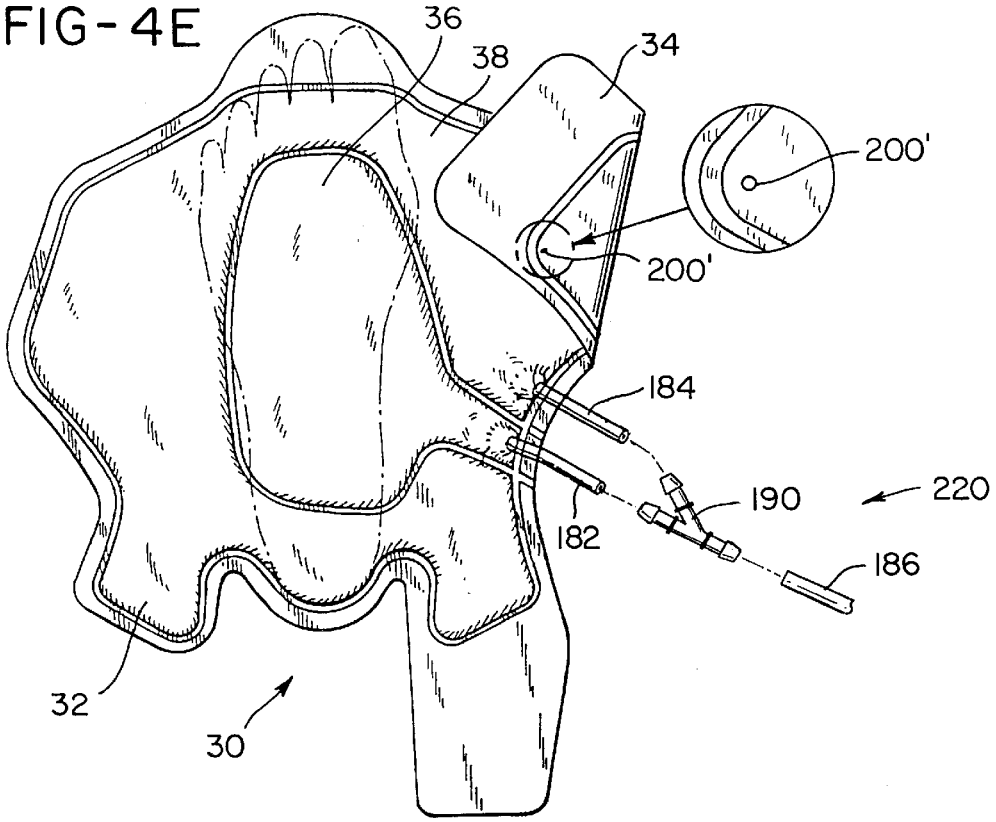
FIG. 4E is a plan view of an inflatable bag and a portion of a conducting line constructed in accordance with a fourth embodiment of the present invention.

A conducting line 220 and inflatable bag 30, formed in accordance with a fourth embodiment of the present invention, are shown in FIG. 4E, where like reference numerals indicate like elements. In this embodiment, the safety vent port 200' is provided in the second panel 34 of the bag 30 such that the vent port 200' communicates directly with the second bladder 38.

The front panel 42*a* is further provided with a liquid crystal display (LCD) 42*c* for displaying the stored operating pressure value and the stored operating time period. The LCD 42*c* also serves to indicate via a visual warning if either or both of the first or second conducting lines are open or obstructed. Light-emitting diodes 42*d* are also provided for indicating whether the generator 40 is operating in the keypad input mode or the processor input mode. Light-emitting diodes 42*f* indicate which fluid outlets are active.

When a fluid pulse is generated by the generator 40, pressurized fluid is transmitted to the bag 30 via the conducting line 50. This results in the first fluid bladder 36 applying a first compressive pressure generally at the plantar arch 62 and the second bladder 36 applying a second, distinct compressive pressure generally at the dorsal aspect 66, the heel 64 and the forward portion 67 of the sole 68 of the foot 60. Application of compressive pressures upon these regions of the foot 60 effects venous blood flow in the deep plantar veins. When a second boot (not shown) is employed, pressurized fluid pulses are transmitted by the generator 40 to its associated inflatable bag so as to effect venous blood flow in the patient's other foot.

Figure 9:
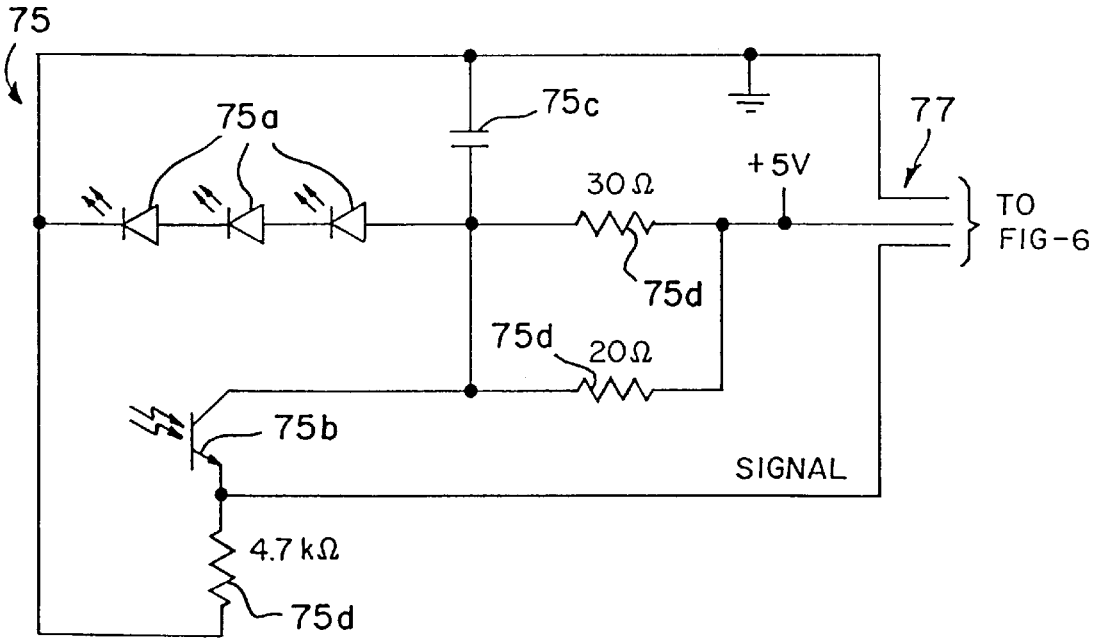
FIG. 9 is a circuit diagram for the infrared sensor illustrated in FIG. 1.

The apparatus 10 further includes an infrared sensor 75, see FIGS. 1 and 9. The sensor 75 can be used in combination with the fluid generator 40 and the processor 70 to allow a physician to prescreen patients before prescribing use of one or two of the boots 20 and the fluid generator 40. The prescreening test ensures that the patient does not have a venous blood flow problem, such as deep vein thrombosis. The prescreening test also allows the physician to predict for each individual patient a preferred time period for vent cycles.

In the illustrated embodiment, the sensor 75 is operatively connected through the generator 40 via cable 77 to the processor 70, see FIGS. 1, 6 and 9. The sensor 75 comprises three infrared-emitting diodes 75*a* which are spaced about a centrally located phototransistor 75*b*. The sensor 75 further includes a filtering capacitor 75*c* and three resistors 75*d*.

The sensor 75 is adapted to be secured to the skin tissue of a patient's leg approximately 10 cm above the ankle via a double-sided adhesive collar (not shown) or otherwise. The diodes 75*a* emit infrared radiation or light which passes into the skin tissue. A portion of the light is absorbed by the blood in the microvascular bed of the skin tissue. A remaining portion of the light is reflected towards the phototransistor 75*b*. An analog signal generated by the phototransistor 75*b* varies in dependence upon the amount of light reflected towards it. Because the amount of light reflected varies with the blood volume in the skin tissue, the analog signal can be evaluated to determine the refill time for the microvascular bed in the skin tissue (also referred to herein as the LRR refill time). Determining the microvascular bed refill time by evaluating a signal generated by a phototransistor in response to light reflected from the skin tissue is generally referred to as light reflection rheography (LRR).

To run the prescreening test, the sensor 75 is first secured to the patient in the manner described above. The patient is then instructed to perform a predefined exercise program, e.g., 10 dorsiflexions of the ankle within a predefined time period, e.g., 10 seconds. In a normal patient, the venous blood pressure falls due to the dorsiflexions causing the skin vessels to empty and the amount of light reflected towards the phototransistor 75*b* to increase. The patient continues to be monitored until the skin vessels are refilled by the patient's normal blood flow.

The signals generated by the phototransistor 75*b* during the prescreening test are buffered by the controller 44 and passed to the processor 70 via the interface cable 72. A digitizing board (not shown) is provided within the processor 70 to convert the analog signals into digital signals.

In order to minimize the effects of noise, the processor 70 filters the digital signals. The processor 70 filters the digital signals by taking 7 samples of sensor data and arranging those samples in sequential order from the lowest value to the highest value. It then selects the middle or "median" value and discards the remaining values. Based upon the median values, the processor 70 then plots a light reflection rheography (LRR) curve. As is known in the art, a physician can diagnose whether the patient has a venous blood flow problem from the skin tissue refill time taken from the LRR curve. An example LRR curve for a normal patient is shown in FIG. 10.

When the sensor 75 is initially secured to the patient's leg, its temperature increases until it stabilizes at approximately skin temperature. Until temperature stabilization has occurred, the signal generated by the sensor 75 varies, resulting in inaccuracies in the LRR curve generated by the processor 70. To prevent this from occurring, the processor 70 monitors the signal generated by the sensor 75 and produces the LRR curve only after the sensor 75 has stabilized. Sensor stabilization is particularly important because, during the stabilization period, the signals generated by the sensor 75 decline at a rate close to the rate at which the skin vessels refill.

Figure 11:
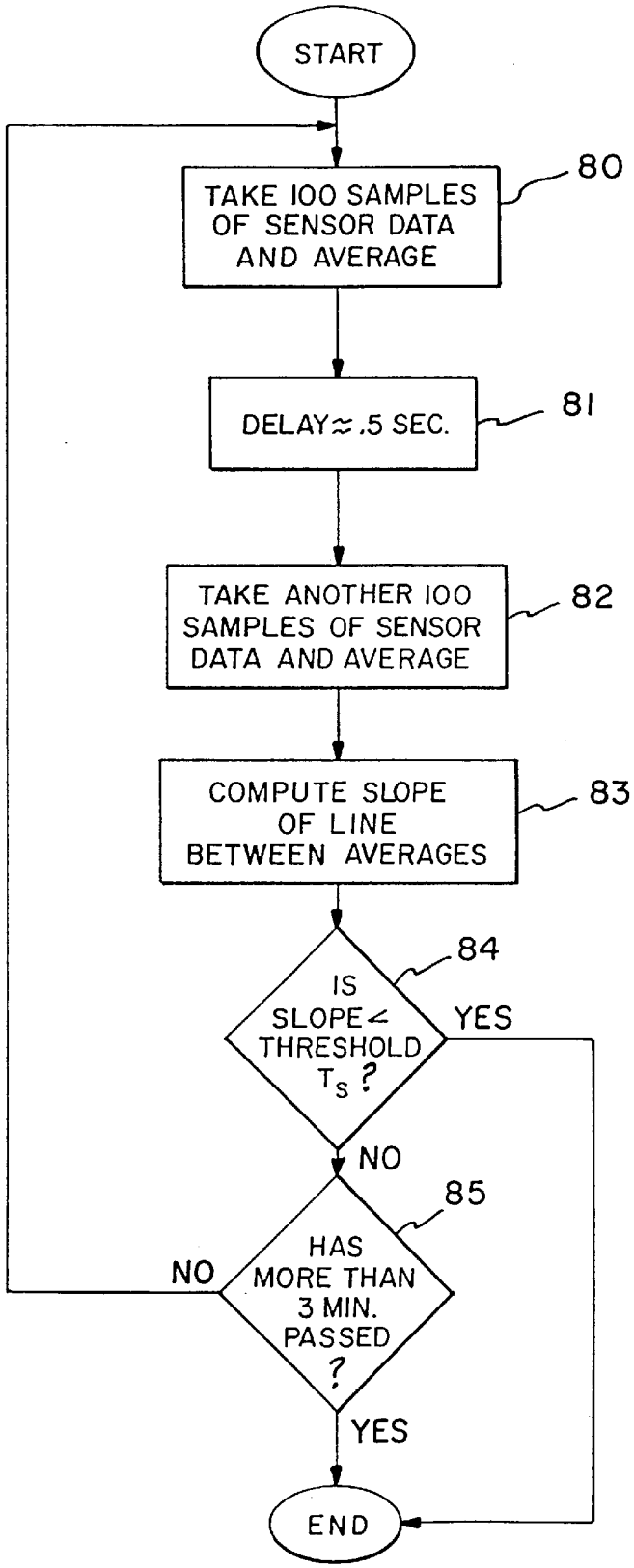
FIG. 11 is a flow chart depicting steps performed to determine stabilization of the infrared sensor signal; and, FIG. 12 is a flow chart depicting steps performed to determine the endpoint on the LRR curve and the LRR refill time.

FIG. 11 shows in flow chart form the steps which are used by the processor 70 to determine if the signal generated by the sensor 75 has stabilized. The first step 80 is to take 100 consecutive samples of filtered sensor data and obtain an average of those samples. After delaying approximately 0.5 second, the processor 70 takes another 100 consecutive samples of sensor data and obtains an average of those samples, see steps 81 and 82. In step 83, the processor 70 determines the slope of a line extending between the averages of the two groups sampled. In step 84, the processor 70 determines if the magnitude of the slope is less than a predefined threshold value $T_s$, e.g., $T_s$=0.72. If it is, stabilization has occurred. If the magnitude of the slope is equal to or exceeds the threshold value $T_s$, the processor 70 determines whether 3 minutes have passed since the sensor 75 was initially secured to the patient's skin, see step 85. Experience has shown that stabilization will occur in any event within 3 minutes. If 3 minutes have passed, the processor 70 concludes that stabilization has occurred. If not, it repeats steps 80–85.

Figure 10:
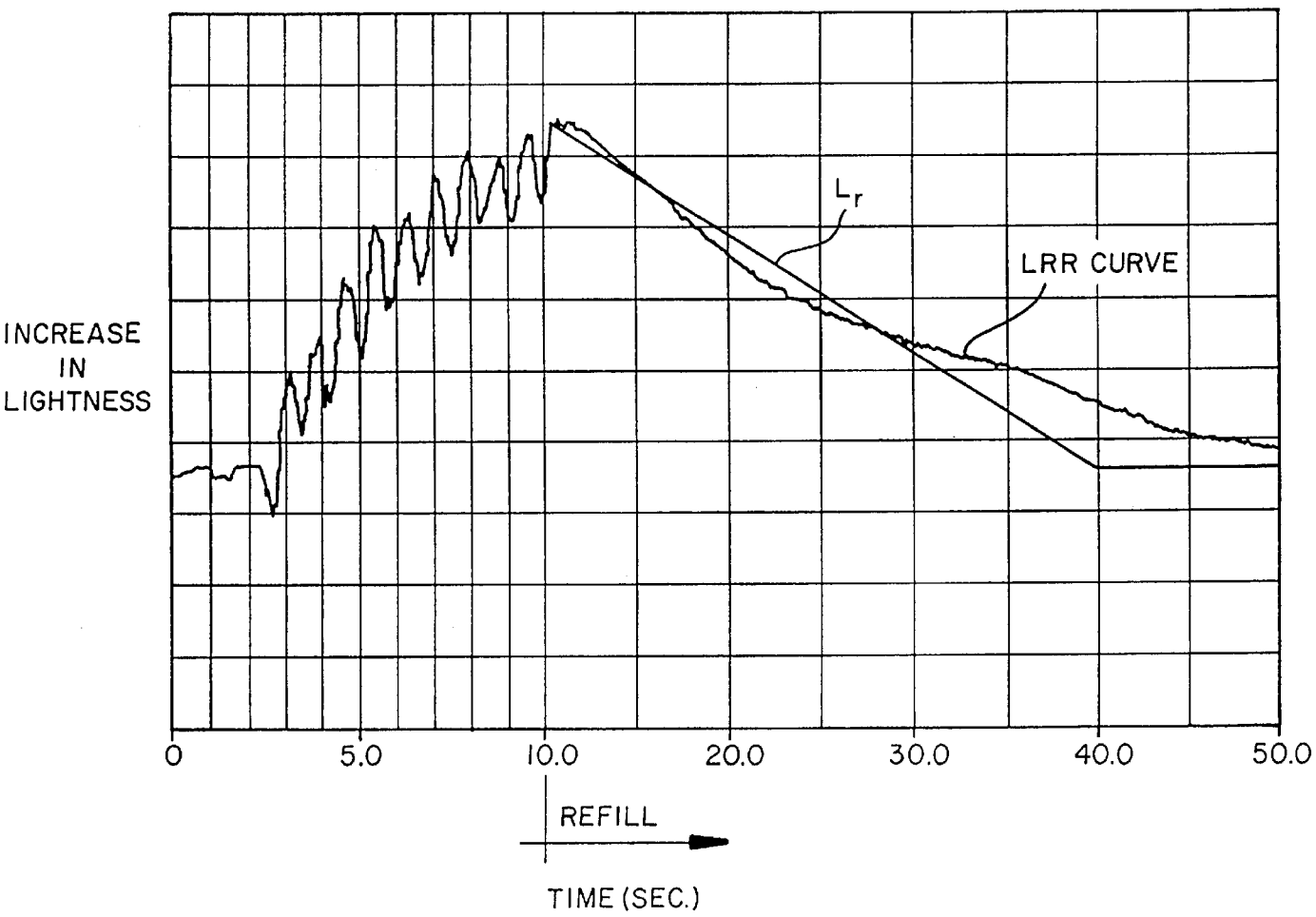
FIG. 10 is an example LRR curve for a normal patient.

After generating the LRR curve, the processor 70 further creates an optimum refill line $L_r$ and plots the line $L_r$ for comparison by the physician with the actual LRR curve, see FIG. 10. The optimum refill line $L_r$ extends from the maximum point on the plotted LRR curve to a point on the baseline, which point is spaced along the X-axis by a selected number of seconds. It is currently believed that this time along the X-axis should be 30 seconds from the X-component of the maximum point; however other times close to 30 seconds may ultimately prove superior.

Figure 12:
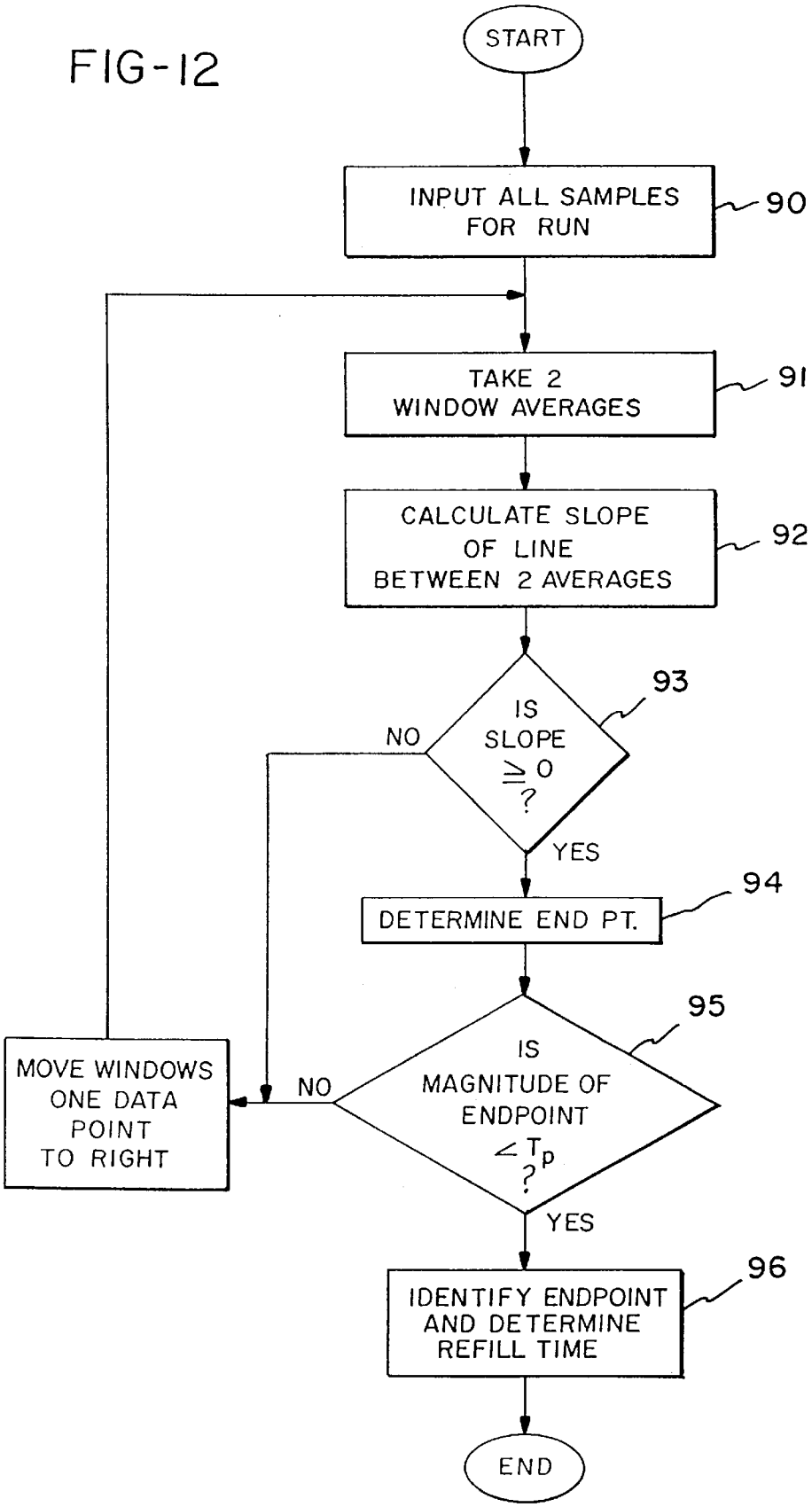

The processor 70 generates the endpoint of the LRR curve and the LRR refill time. FIG. 12 shows in flow chart form the steps which are used by the processor 70 to determine the endpoint on the LRR curve and the refill time.

In step 90, all filtered samples for a single prescreening test are loaded into the processor 70. In step 91, two window averages are determined. In a working embodiment of the invention, each window average is determined from 30 filtered data points, and the two window averages are separated by 5 filtered data points. Of course, other sample sizes for the windows can be used in accordance with the present invention. Further, the number of data points separating the windows can be varied. In step 92, the slope of a line extending between the two window averages is found. In step 93, if the slope is less than 0, the processor 70 moves the windows one data point to the right and returns to step 91. If the slope is greater than or equal to zero, the processor 70 determines the endpoint, see step 94. The endpoint is determined by identifying the lowest and highest data points from among all data points used in calculating the two window averages and taking the centerpoint between those identified data points. The processor then determines if the magnitude of the endpoint is less than a threshold value $T_p$ (e.g., $T_p$=[peak value—(0.9) (peak value—baseline value)]), see step 95. If the endpoint is greater than or equal to the threshold value $T_p$, the processor 70 moves the windows one data point to the right and returns to step 91. If the endpoint is less than the threshold value $T_p$, the processor 70 identifies the endpoint and calculates the LRR refill time, see step 96. The LRR refill time is equal to the time between the maximum point on the LRR curve and the endpoint.

Further in accordance with the present invention, the processor 70 determines a preferred time period for the periodic vent cycles by estimating the refill time period for the patient's deep plantar veins based upon the determined LRR refill time. In order to determine the refill time period for the deep plantar veins, an equation is generated in the following manner.

LRR plots for a group of patients are generated in the manner described above using the boot 20, the inflatable bag 30, the fluid generator 40, the processor 70 and the sensor 75. The group must include patients ranging, preferably continuously ranging, from normal to seriously abnormal. The LRR refill time is also generated for each of these patients.

Refill times for the deep plantar veins are additionally determined for the patients in the group. The refill time is determined for each patient while he/she is fitted with the boot 20 and the inflatable bag 30 has applied compressive pressures to his/her foot. An accepted clinical test, such as phlebography or ultrasonic doppler, is used to determine the refill time for the deep plantar veins.

Data points having an X-component equal to the LRR refill time and a Y-component equal to the refill time for the deep plantar veins are plotted for the patients in the group. From those points a curve is generated. Linear regression or principal component analysis is employed to generate an equation for that curve. The equation is stored in the processor 70.

From the stored equation, the processor 70 estimates for each patient undergoing the prescreening test the patient's deep plantar veins refill time based upon the LRR refill time determined for that patient. The preferred time period for the periodic vent cycles is set equal to the deep plantar veins refill time and that preferred time period is transmitted by the processor 70 to the controller 44 for storage by the controller 44 as the operating time period for the periodic vent cycles.

It is further contemplated by the present invention that a look-up table, recorded in terms of LRR refill time and deep plantar veins refill time, could be stored within the processor 70 and used in place of the noted equation to estimate the preferred time period for the periodic vent cycles.

A program listing (written in Basic) in accordance with the present invention including statements for (1) determining stabilization of the sensor 75; (2) median filtering; and (3) determining the endpoint of the LRR curve is set forth below:

```
5 REM
  rem
  rem
  rem
  rem
  rem
  rem
  rem
  rem
  dim stemp(100),wrd(4),tword(7)
 out &h02f0,&h04          'reset the A/D's
 for dly=1 to 5000:next dly
 out &h02f0,&h18  'get ready for sampling
open "I",#4,"CVI.INI"
        cls:screen 9
        line (0,0)-(639,439),15,b
        line (3,3)-(636,346),15,b
input #4,cport
input #4,d$:input #4,pth$
close #4
locate 4,5:input "Patients Name (First initial and Last):";iname$
        iname$=iname$ + "          "    'add padding spaces for short names
        iname$=left$(iname$,10)
        8 locate 5,5:input "Patients Age:";iage
        if iage>100 then 8
        locate 6,5:input "Which leg (right, left):";ileg$
        ileg$=ileg$ + "   +"              'add space padding
        ileg$=left$(ileg$,5)
        calflag=0
9 gosub 8000      'Wait on sensor temperature stabilization
10 CLS
15 DIM CVT(1441),overlay(1441)
16 XORG=75:YORG=278:PI=3.1415927#
17 FLAG=1:F$="##.##":G$="##.#"
  rem <<Initialize the gain settings and D.P. variables>>
        G#=25.00#          'initial gain setting
        bias#=75.00#       'set this where you want the trace bottom
        ybase#=-1000.00#   'trigger the calibration message on 1st pass
        gmax#=25.00#       'sets the maximum allowable gain (35 orig.)
        maxdelta#=0.00#    'setup max and min for actual range
        mindelta#=210.00#
        fillchk=0
80 gosub 11000   'display setup
        LOCATE 23,5
        PRINT "X=RETURN TO DOS    <Spc Bar>=CVI TEST    O=OVERLAY    S=STORE/RETRIEVE
188 GOSUB 1000
190 gosub 11100 'display blanking
280 REM    DATA DISPLAY ROUTINE
320 REM **** Get input and display point ****
325 erase CVT:sum=0:yavg#=0.0#:calflag=1:maxdelta#=0.0#;mindelta#=210.0#
        name$=iname$:leg$=ileg$:age=iage
        patdat$=date$:pattim$=time$
        locate 3,5:print patdat$;"| | ";pattim$;
        locate 3,31:print "Patient: ";name$;:locate 3,53:print "Age: ";age;
        locate 3,64:print "<";leg$;" Leg>";
        locate 24,28:print "Refill Time (SEC): ";using "##.#";0.0;
  rem << DO the Baseline Request (BRQ) >>
  for j=1 to 5
  gosub 2000
  yavg#=yavg#+temp#
  next j
  ybase#=yavg#/5.0#
330 FOR I=1 TO 1440:skip=0
   if i>480 then skip=1
331 for jx=1 to skip:gosub 2000:next jx      'wait skip sample intervals
   rem *** Standard plot for reference - (green line)***
   if i<=504 then 332
   ystep=ystep-(CVT(504)-bias#)/720
  if ystep<bias# then ystep=bias#
  if i=505 and CVT(504)<203 then
    circle(XORG+I/1440*490,yorg-Ystep),7,12          'ident fillrate start
    circle(XORG+I/1440*490,yorg-Ystep),8,12
    fillchk=1
  end if
  if CVT(504)>131 then pset (XORG+I/1440*490,york-Ystep),10
```

-continued

```
332 k$=inkey$:if k$=""then 333
    rem *** Interrupt Sequence ***
    for rmdr=i to 1440:CVT(rmdr)=yval:next rmdr
    colr=15
    ovlflg=0    'disable any overlaying on an abort sequence
    fillchk=0:fillrate=0
    gosub 7000
    goto 420    'escape sequence
333 rem metronome setup for 10 dorsiflexions
    rem start signal
    if i=48 then sound 500,10
    iraw=i/39:iint=int(i/39)
    if i>80 and i<470 and iraw=iint then sound 1200,1
335 gosub 2000       'gosub 2000 get input subroutine
336 CVT(I)=yval
    if i=504 then ystep=yval
    if ydelta#>maxdelta# then maxdelta#=ydelta#
    if ydelta#<mindelta# then mindelta#=ydelta#
400 LINE (XORG+(I-1)/1440*490,YORG-CVT(I-1))-(XORG+I/1440*490,YORK-CVT(I)),15
408 NEXT I
    rem *** Routine to find trace endpoint and calculate filltime ***
  if fillchk=1 then    'find the trace endpoint
  for i=505 to 1410  'scan through all saples
  cvtsum1=0:cvtsum2=0
  for n=1 to 30:cvtsum1=cvtsum1+cvt(i+n-35):cvtsum2=cvtsum2+cvt(i+n):next n
  cvtavg1=cvtsum1/30:cvtavg2=cvtsum2/30
  diff=(cvtavg2-cvtavg1)
  if diff > -.50 and cvt(i) < .10 * (cvt(504)-bias#) + bias# then
      for n=1 to 30
      if abs(cvt((i-15)+n)-cvt(i))>9 then 409       'artifact rejection
      next n
      fulptr=i
      if cvt(fulptr)<7 then 410    'don't print endpoint circle (bottom)
      circle(XORG+fulptr/1440*490,YORG-CVT(fulptr)),7,12       'ident fillrate sto
      circle(XORG+fulptr/1440*490,YORG-CVT(fulptr)),8,12
      goto 410
  end if
409 next i
        fulptr=1419
        if cvt(fulptr)<7 then 410    'don't print endpoint circle (bottom)
        circle(XORG+fulptr/1440*490,YORG-CVT(fulptr)),7,12       'ident fillrate sto
        circle(XORG+fulptr/1440*490,YORG-CVT(fulptr)),8,12
410     fillrate= (fulptr-504)/24
        fillrate=int(fillrate*10)/10
        fillchk=0
  end if
  locate 24,28:print "Refill Time (SEC): ";using "##.#";fillrate;
  deltamax#=(maxdelta#-mindelta#)
  if deltamax#=0 then deltamax#=1
  gosub 2600    'do the nominal gain adjust
420 rem <end of pass>
422 LET K$=INKEY$:IF K$="x" OR K$="X" THEN STOP
424 IF K$="S" OR K$="s" THEN GOSUB 5000 ' FILE ROUTINE
425 IF K$="O" OR K$="o" THEN gosub 9000 ' overlay handler
427 IF K$="" THEN 422       'wait for keypress
460 GOTO 4522
465 rem   DIRECTORY
        cls
        files d$+pth$
        locate 24,5:print"Press any key to continue:";
468     k$=inkey$:if k$="" then 468
        cls
        gosub 11000    'display setup
        if vect=2 then goto 9000   'return to overlay routine
        goto 5000                  'return to file routine
1000 REM introduction
1004 LOCATE 10,27:PRINT"CVI TEST AND STORE OPTION"
1006 LOCATE 15,15:PRINT"PRESS SPC BAR TO START TEST, ESC TO RETURN TO SYSTEM"
1010 LET K$=INKEY$:IF K$="" THEN 1010
1020 IF asc(K$)=27 THEN SYSTEM
1024 IF K$="S" OR K$="s" THEN GOSUB 5000:goto 420    'FILE ROUTINE
1025 IF K$="x" OR K$="X" THEN CLS:STOP
1030 if k$=" " then RETURN
1040 goto 10010
1500 rem *** Calibrate message ***
1520 line(130,195)-(500,255),15,bf
1530 locate 16,23:print " Attention!! System is Calibratine "
1540 locate 17,23:print " Wait until finished, then Retest. "
1545 calflag=0
1560 return
```

-continued

```
2000 REM ***Get input value from A/D converter***
     'includes software fixes for lousy a/d converter equipment
     for smpl=1 to 5                'take 5 samples
     out &h02f0,&h08                'strobe HOLD and take a sample
     out &h02f0,&h18                'reset for next sample
     for dly=1 to 86:next dly
     let msb=inp(&h02f6)
     let lsb=inp(&h02f6)
     tword(smpl)=(256*msb+lsb)
     next smpl
     for g=1 to 4                   'bubble sort for median value
     for h=1 to 4
     if tword(h)>tword(h+1) then
          temp=tword(h)
          tword(h)=tword(h+1)
          tword(h+1)=temp
     end if
     next h
     next g
2047 csword#=tword(3)                    'choose median value
     TEMP#=cswored#/65536.0#*210.0#
     ydelta#=(temp#-ybase#)
     yval=G#*ydelta#+bias#
     if yval>210 then yval=210
     if yval>207 and calflag=1 then gosub 1500
     if yval<0 then yval=0
2050 RETURN
2600 rem << Nominal Gain adjust >>
     maxpixel#=195.00#
     G#=(maxpixel#-bias#)/deltamax#   'set the new gain
     if G#>gmax# then G#=gmax#
2610 return
4005 gosub 11100     'redraw cvi display
4060 FOR I=1 TO 1440
4070 LINE(XORG+(I-1)/1440*490,YORG-CVT(I-1))-(XORG+I/1440*490,YORG-CVT(I)),15
4080 NEXT I
4085 LOCATE 23,5:PRINT"X=RETURN TO DOS     <Spc Bar>=CVI TEST     O=OVERLAY     S=STORE/R
     locate 3,5:color 15:print patdat$;" | | ";pattim$;
     locate 3,31:print "Patient: ";name$;:locate 3,53:print "Age: ";age;
     locate 3,64:print "<";leg$;" Leg>";
     locate 24,28:print "Refill Time (SEC): ";using "##.#";fillrate;
4090 K$="":RETURN
5000 REM FILE HANDLER
5001 c=0
5005 LINE(75,68)-(565,278),12,bf
5010 LOCATE 23,5:PRINT"
5170 LOCATE 8,14:PRINT"<S>AVE FILE"
5175 LOCATE 10,15:PRINT "FILE NAME"
5177 LOCATE 12,13:PRINT d$;"_.DAT"
5190 LOCATE 15,12:PRINT"<R>ETRIEVE FILE"
5210 LOCATE 17,15:PRINT"FILE NAME"
5230 LOCATE 19,13:PRINT d$;"_.DAT"
5340 LOCATE 6,14:PRINT"<M>AIN MENU":locate 6,50:print"<D>irectory"
5400 REM ** Input handler **
5410 LET K$=INKEY$:IF K$="" THEN 5410
5420 IF K$="M" OR K$="m" THEN colr=11:GOTO 7000       'REDRAW DISPLAY
5430 IF K$="R" OR K$="r" THEN GOTO 5510
5440 IF K$="S" OR K$="s" THEN GOTO 5460
     if k$="D" or k$="d"0 then vect=1:goto 465
5450 GOTO 5410
5460 LOCATE 12,15,1        'SAVE
5465 PRINT "*";
5470 I$=INKEY$:IF I$="" THEN 5470
5474 IF ASC(I$)=13 THEN c=0:goto 5600
5475 IF ASC(I$)=8 THEN GOSUB 6750:goto 5470
5476 IF ASC(I$)=27 THEN 5000
5477 IF ASC(I$)<48 OR ASC(I$)>122 THEN 5470
5478 IF ASC(I$)>57 AND ASC(I$)<64 THEN 5470
5479 IF ASC(I$)>90 AND ASC(I$)<97 THEN 5470
5490 IF C<8 THEN sd$=sd$%+I$:PRINT I$;:C=C+1
5500 GOTO 5470
5510 LOCATE 19,15,1        ' RETRIEVE ROUTINE
5520 PRINT "*";
5530 I$=INKEY$:IF I$="" THEN 5530
5540 IF ASC(I$)=13 THEN c=0:goto 6600
5550 IF ASC(I$)=8 THEN GOSUB 6750:goto 5530
5560 IF ASC(I$)=27 THEN 5000
5570 IF ASC(I$)<48 OR ASC(I$)>122 THEN 5530
5580 IF ASC(I$)>57 AND ASC(I$)<64 THEN 5530
5590 IF ASC(I$)>90 AND ASC(I$)<97 THEN 5530
```

-continued

```
5595 IF C<8 THEN rt$=rt$+I$:PRINT i$;:C=C+1
5597 GOTO 5530
5600 REM ** Output file to Disk **
5605 ON ERROR GOTO 6710
5610 FILE$=d$+pth$+SD$+".DAT":SD$=""
5620 OPEN "O",#1,FILE$
5630 FOR SAMPLE=1 TO 1440
5640 WRITE #1,CVT(SAMPLE)
5650 NEXT SAMPLE
     write #1,kname$,age,leg$,patdat$,pattim$,fillrate
5660 CLOSE #1
     colr = 15
5670 ovlflg=0:GOTO 7000 ' REDRAW DISPLAY
6600 REM **** INPUT FILE FROM DISK *******
6610 FILE$=d$+pth$+RT$+".DAT":RT$=""
6620 OPEN "I",#1,FILE$
6630 FOR SAMPLES =1 TO 1440
6640 INPUT #1,CVT(SAMPLE)
6650 NEXT SAMPLE
     input #1,name$,age,leg$,patdat$,pattim$,fillrate
6660 CLOSE 1
     colr = 11
6670 ovlflg=0:GOTO 7000        ' DISPLAY NEW DATA
6700 REM *** Error Handling **
6705 LOCATE 23,5:PRINT "FILE NOT FOUND!":GOTO 6720
6710 LOCATE 23,5:PRINT "DISK DRIVE NOT READY!"
6720 FOR DLY=1 TO 55000:NEXT DLY
     close 1
6730 RESUME 5000
6740 END
6750 REM ***CORRECTION ALGORITHM***
6760 IF POS(X)<=16 THEN RETURN
6770 C=C-1
6780 SD$=LEFT$(SD$,C)
6785 RT$=LEFT$(RT$,C)
6790 BKS=POS(X)
6795 BKY=CSRLIN
6800 LOCATE BKY,(BKS-1)
6805 PRINT"_";
6810 LOCATE BKY,(BKS-1)
6820 RETURN
7000 REM reconstruct display and data routines
7001 CVT(0)=0
     gosub 11100    'redraw cvi display
7060 for i=1 to 1440
7070 LINE(XORG+(I-1)/1440*490,YORG-CVT(I-1))-(XORG+I/1440*490,YORG-CVT(I)),15
     if ovlflg=1 then
     LINE(XORG+(I-1)/1440*490,YORG-overlay(I-1))-(XORG+1/1440*490,YORG-overlay(I
     end if
7080 NEXT I
7085 LOCATE 23,5:PRINT"X=RETURN TO DOS    <Spc Bar>=CVI TEST    O=OVERLAY    S=STORE/R
     locate 3,5:color colr:print patdat$;" || ";pattim$;
     locate 3,31:print "Patient: ";name$;:locate 3,53:print "Age: ";age;
     locate 3,64:print "<";leg$;" Leg>";
     locate 24,28:print "Refill Time (SEC): ";using "##.#";fillrate;
     color 15
7090 K$="":RETURN
8000 rem *** Wait on sensor temperature stabilization ***
          cls:screen 9
          line (0,0)-(639,349),15,b
          line (3,3)-(636,346),15,b
          G#=10.00#        'set gain value
          bias#=75.00#     'sets bias to active range
          locate 2,5
          print "<<<<<<<<<<<<<<<<<<<<<<<<<<<<<<<<< CVI Test >>>>>>>>>>>>>>>>>>>>>>>>>>
          locate 4,5
          print "Attach the optical sensor to the patient's leg using the adhesive
          locate 5,5
          print "collar. Locate the sensor four inches above the ankle on the
          locate 6,5
          print "interior side of the leg."
          locate 8,5
          print "Plug the sensor into the connector on the Powerpoint Hemopulse un
          locate 10,5
          print "<Press any key when finished, (B) to Bypass warmup>"
8010      k$=inkey$:if k$="" then 8010
          if k$="B" or k$="b" then return
          locate 15,5
          print "Please remain stationary while the sensor temperature stabilizes.
8020      locate 18,25
```

-continued

```
            print "Calibrating - please wait."
            let stime!=timer
8025        k$=inkey$:if k$="B" or k$="b" then return
            if (timer-stime!) <15 then 8025          'start 15 second minimum wait
8027        rem stabilization routines
            locate 18,25
            print "Temperature now stabilizing"
            for i=1 to 100        'get 100 conseq. samples
            gosub 2000        'get input
            let stemp(i)=temp#*g#
            next i
            for dly=1 to 50000:next dly
            locat 18,25
            print "                    "      'toggle the prompt
            k$=inkey$:if k$="B" or k$="b" then return
8030        rem << Average Filter >>
            for j=1 to 100
            let savg=savg+stemp(j)
            next j
            savg=savg/100
            if abs(savg-lastavg) < .720 then return
            lastavg=savg:savg=0
            if (timer-stime) >180 then return
            for dly=1 to 35000:next dly
            yavg#=0        'reset for next try
            goto 8027
9000 rem ** Handle Overlay routine **
9001 c=0
9005 LINE(75,68)-(565,278),12,bf
9010 LOCATE 23,5:PRINT"
9190 LOCATE 15,15:PRINT"<O>VERLAY FILE"
9210 LOCATE 17,15:PRINT"FILE NAME"
9230 LOCATE 19,13:PRINT d$;"_.DAT"
9340 LOCATE 6,14:PRINT"<M>AIN MENU":locate 6,50:print"<D>irectory"
9400 REM ** Input handler **
9410 LET K$=INKEY$:IF K$="" THEN 9410
9420 IF K$="M" OR K$="m" THEN colr=11:GOTO 7000    ' REDRAW DISPLAY
9430 IF K$="O" OR K$="o" THEN GOTO 9510
     IF K$="D" or k$="d" then vect=2:goto 465
9440 goto 9410
9510 LOCATE 19,15,1          ' overlay ROUTINE
9520 PRINT "*";
9530 I$=INKEY$:IF I$="" THEN 9530
9540 IF ASC(I$)=13 THEN c=0:goto 9600
9550 IF ASC(I$)=8 THEN GOSUB 6750:goto 9530
9560 IF ASC(I$)=27 THEN 9000
9570 IF ASC(I$)<48 OR ASC(I$)>122 THEN 9530
9580 IF ASC(I$)>57 AND ASC(I$)<64 THEN 9530
9590 IF ASC(I$)>90 AND ASC(I$)<97 THEN 9530
9595 IF C<8 THEN rt$=rt$+I$:PRINT I$;:C=C+1
9597 GOTO 9530
9600 REM **** INPUT FILE FROM DISK *******
9605 ON ERROR GOTO 10700
9610 FILE$=d$+pth$+RT$+".DAT":RT$=""
9620 OPEN "I",#1,FILE$
9630 FOR SAMPLE =1 TO 1440
9640 INPUT π1,overlay(SAMPLE)
9650 NEXT SAMPLE
     'input #1,nothing$,nothing$
9660 CLOSE 1
     colr = 11
9670 ovlflg=1:GOTO 7000        ' DISPLAY NEW DATA
10700 rem ** Error Handler for overlay **
10705 LOCATE 23,5:PRINT "FILE NOT FOUND!"
10720 FOR LDY=1 TO 55000:NEXT DLY
     close 1
11000 REM DISPLAY SETUP
            LOCATE 1,33:PRINT CHR$(3) CHR$(3)    " CVI DISPLAY "    CHR$(3) CHR$(3)
            LINE (28,48)-(590,298),15,B
            LINE (74,67)-(566,279),15,B
            LOCATE 21,8:PRINT USING G$;0: LOCATE 21,29:PRINT USING G$;10
            locate 21,18:print using g$;5
            LOCATE 21,50:PRINT USING G$;30 : LOCATE 21,69:PRINT USING G$;50
            locate 21,39:print using g$;20 : locate 21,59:print using g$;40
            LOCATE 5,15:PRINT"1.00" : LOCATE 8,5:PRINT"0.80"
            LOCATE 11,5:PRINT"0.60": LOCATE 14,5:PRINT"0.40"
            LOCATE 17,5:PRINT"0.20": LOCATE 20,5:PRINT "0.00"
            LOCATE 2,28:PRINT" <LR Rheography vs Seconds> "
return
11100 REM display area - blanking
```

-continued

```
        LINE (76,58)-(565,278),0,BF
        FOR I=0 TO 8:LINE(I*490/12+238.334,68)-(I*490/12+238.334,278),11:NEXT I
        for i=0 to 10:line(i*163/10+75,68)-(i*163/10+75,278),11:next i '10 secon
        FOR I=0 TO 10:LINE(75,I*210/10+68)-(565,I*210/10+68),11:NEXT I      'grid
        LINE (75,173)-(565,173),12                    'center black line
        LOCATE 1,33:PRINT CHR$(3) CHR$(3)
        LOCATE 1,48:PRINT CHR$(3) CHR$(3)
return
```

From the above disclosure of the general principles of the present invention and the preceding detailed description, those skilled in this art will readily comprehend the various modifications to which the present invention is susceptible. Therefore, the scope of the invention should be limited only by the following claims and equivalents thereof.

What is claimed is:

1. A medical device for applying compressive pressures against a patient's limb extremity comprising:

an inflatable bag to be fitted upon the limb extremity, said bag having at least one air bladder adapted to engage at least one portion of the limb extremity; and an air supply mechanism for applying pressurized air to said at least one bladder such that a compressive pressure is applied upon the at least one portion of the limb extremity, said air supply mechanism including an electrically powered fluid compressor for providing said pressurized air and a reservoir for storing pressurized air from said compressor, said compressor comprising:

a housing, a piston mounted in said housing for drawing air into and forcing air out of said housing, and an exhaust valve assembly mounted on said piston, said assembly including an exhaust valve and an exhaust filter, said exhaust valve being disposed so that the air pressurized by said compressor must pass through said exhaust valve before being forced out of said housing, and said exhaust filter being disposed so that the air pressurized by said compressor must sass through said exhaust filter before passing through said exhaust valve.

2. A medical device as set forth in claim 1, wherein said compressor internally generates airborne particulate matter during its operation and the performance of said exhaust valve is sensitive to the accumulation of such particulate thereon to the point that such accumulation significantly reduces the efficiency and output of said compressor.

3. An electric air compressor suitable for providing pressurized air to an air supply mechanism which applies the pressurized air to at least one bladder adapted to engage a patient's limb extremity so as to apply compressive pressures against the limb extremity, said compressor comprising:

a housing;

a piston mounted in said housing for drawing air into and forcing air out of said housing; and an exhaust valve assembly mounted on said piston, said assembly including an exhaust valve and an exhaust filter, said exhaust valve being disposed so that the air pressurized by said compressor must pass through said exhaust valve before being forced out of said housing, and said exhaust filter being disposed so that the air pressurized by said compressor must pass through said exhaust filter before passing through said exhaust valve.

4. An air compressor as set forth in claim 3, wherein said piston generates airborne particulate matter during its operation, and the performance of said exhaust valve is sensitive to the accumulation of such particulate thereon to the point that such accumulation can significantly reduce the efficiency and output of said compressor.

5. An air compressor as set forth in claim 3, wherein said exhaust valve assembly includes an assembly housing and said exhaust valve is a reed valve mounted on said assembly housing.

6. An air compressor as set forth in claim 3, wherein said exhaust valve assembly includes an assembly housing that defines an exhaust port through which air pressurized by said compressor must pass before passing through said exhaust valve, and said exhaust filter is disposed across said exhaust port.

7. An air compressor as set forth in claim 6, wherein said exhaust filter is disposed in a bore hole defined by said assembly housing, said bore hole is formed across and through said exhaust port such that any air passing through said exhaust valve must first pass through said exhaust filter.

8. An air compressor as set forth in claim 6, wherein said housing defines an air chamber, and the air pressurized by said compressor enters said air chamber after passing through said exhaust valve and passes out of said air chamber before being forced out of said housing.

* * * * *

UNITED STATES PATENT AND TRADEMARK OFFICE
CERTIFICATE OF CORRECTION

PATENT NO : 5,840,049

DATED : November 24, 1998

INVENTOR(S) : David Malcolm Turney et al.

It is certified that errors appear in the above-identified patent and that said Letters Patent is hereby corrected as shown below:

Column 25, Line 39 reads "compressor must sass" should read --compressor must pass--.

Signed and Sealed this

Ninth Day of March, 1999

*Attest:*

*Attesting Officer*

Q. TODD DICKINSON

*Acting Commissioner of Patents and Trademarks*